US007885596B2

(12) United States Patent
Iwago et al.

(10) Patent No.: US 7,885,596 B2
(45) Date of Patent: Feb. 8, 2011

(54) DOCUMENT OR SHEET MATERIAL FEEDER

(75) Inventors: Toshitaka Iwago, Nagoya (JP); Ryoichi Matsushima, Nagoya (JP); Yoichi Horaguchi, Tajimi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 548 days.

(21) Appl. No.: 11/581,377

(22) Filed: Oct. 17, 2006

(65) Prior Publication Data

US 2007/0086816 A1 Apr. 19, 2007

(30) Foreign Application Priority Data

Oct. 17, 2005 (JP) ..... 2005-301331

(51) Int. Cl.
*G03G 15/00* (2006.01)

(52) U.S. Cl. ..... 399/367; 271/291

(58) Field of Classification Search ..... 399/367; 271/291

See application file for complete search history.

(56) References Cited

U.S. PATENT DOCUMENTS 5,503,384 A * 4/1996 Fukube ..... 271/18.2
6,151,478 A 11/2000 Katsuta
6,438,350 B1 8/2002 Hasegawa et al.
2003/0122299 A1* 7/2003 Soga et al. ..... 271/182
2005/0058477 A1* 3/2005 Aoki et al. ..... 399/367
2005/0206075 A1* 9/2005 Yago ..... 271/272
2005/0206970 A1* 9/2005 Kim ..... 358/486

FOREIGN PATENT DOCUMENTS

JP 08113432 A * 5/1996
JP 10087108 4/1998
JP 11314855 A * 11/1999
JP 2000-344384 A 12/2000
JP 2001328759 A * 11/2001
JP 2003-312903 A 11/2003

OTHER PUBLICATIONS

JP Office Action dtd Jul. 8, 2008, JP Appln. 2005-301331 (partial translation).

* cited by examiner

*Primary Examiner*—Daniel J Colilla
*Assistant Examiner*—Allister Primo
(74) *Attorney, Agent, or Firm*—Banner & Witcoff, Ltd

(57) ABSTRACT

A document feeder includes a document feed unit that feeds a document along a document feed path extending from a document loading section to a document output section via a scanning position. The document feed unit includes a first feed roller pair nipping and feeding a document opposed to the scanning position at a position downstream in a feed direction from the scanning position, and a second feed roller pair nipping and feeding the document fed by the first feed roller pair at a document feed speed higher than that of the first feed roller pair at a position downstream in the feed direction from the first feed roller pair.

14 Claims, 16 Drawing Sheets

DOCUMENT OR SHEET MATERIAL FEEDER

CROSS REFERENCE TO RELATED APPLICATION

This application claims priority from Japanese Patent Application No. 2005-301331, filed on Oct. 17, 2005, the entire subject matter of which is incorporated herein by reference.

TECHNICAL FIELD

Illustrative aspects of the present invention relate to an automatic document feeder suited for the double-sided reading of documents or other sheet materials.

BACKGROUND

In the prior art, an image reading apparatus to be mounted on a copier, a scanner, or a multifunction device having the functions of the former is known to have an automatic document feeder (ADF) for transferring a document from a input tray through a transfer path to an output tray (for example, see JP-A-10-87108). There is also known an automatic document feeder by reversing leading and trailing ends of a document by reversible roller while the document is being transferred.

FIG. 15 shows a route in the automatic document feeder of the prior art. As shown, a document P placed on an input tray 100 with its first side (or first page) is being directed upward is fed by a pick-up roller 101 to a transferring path 102 by a pick-up roller 101. In the transfer path 102, the document P is transferred by suitably disposed transfer rollers 103 so that its first side is scanned while passing through a scanning position X by image reader such as a charge-coupled device (CCD) or a contact image sensor (CIS). When the document P having its first side read is detected at its trailing end by a sensor, reversible rollers 104 are stopped while nipping the trailing end of the document.

As shown in FIG. 16, the reversible rollers 104 reverse the transfer direction of the nipped document to a return path 105. The document P transfers again from the return path 105 to the upstream side of the scanning position X of the transfer path 102. As a result, the leading end and the trailing end of the document P are reversed. Then, the document P is transferred by the transfer rollers 103 so that its second side is read while being passed through the scanning position X by the image reader. When the document P having its two sides scanned is detected at its trailing end by the sensor, the reversible rollers 104 are stopped again while nipping the trailing end of the document. The document P having transferred again from the return path 105 into the transfer path 102 is reversed again at its leading end and the trailing end entering a state in which the first side opposes the scanning position X. Then, the document P is transferred through the transfer path 102 and then is discharged with its first side being in a downward direction relative to an output tray 106. As a result, the document P has both its sides read, and is discharged to the output tray 106 in the same order as when the document was placed on the input tray 100.

SUMMARY

Aspects of the invention relate to systems and methods for moving or conveying documents or other sheet type materials, e.g., in various document or sheet handling systems, such as those included in image forming apparatuses. Feeder systems according to at least some examples of this invention may include: an inlet; an outlet; a transfer path extending between the inlet and outlet; a transfer system that moves a document or other material along the transfer path. Such transfer systems further may include one or more of the following: a first transfer element included in the transfer system at a position downstream of the scanning point; a second roller that is provided at position downstream of the first roller. The drive system may be structured, programmed, and/or adapted so as to control the transfer system, in at least some instances, operation of the transferring force of the second roller is greater than that of the first roller.

DETAILED DESCRIPTION

Hereinafter, an aspect of the present invention will be described with reference to the attached drawings. The aspect is only an example of the invention and the aspect can be properly modified without departing from the scope of the invention.

Figure 1:
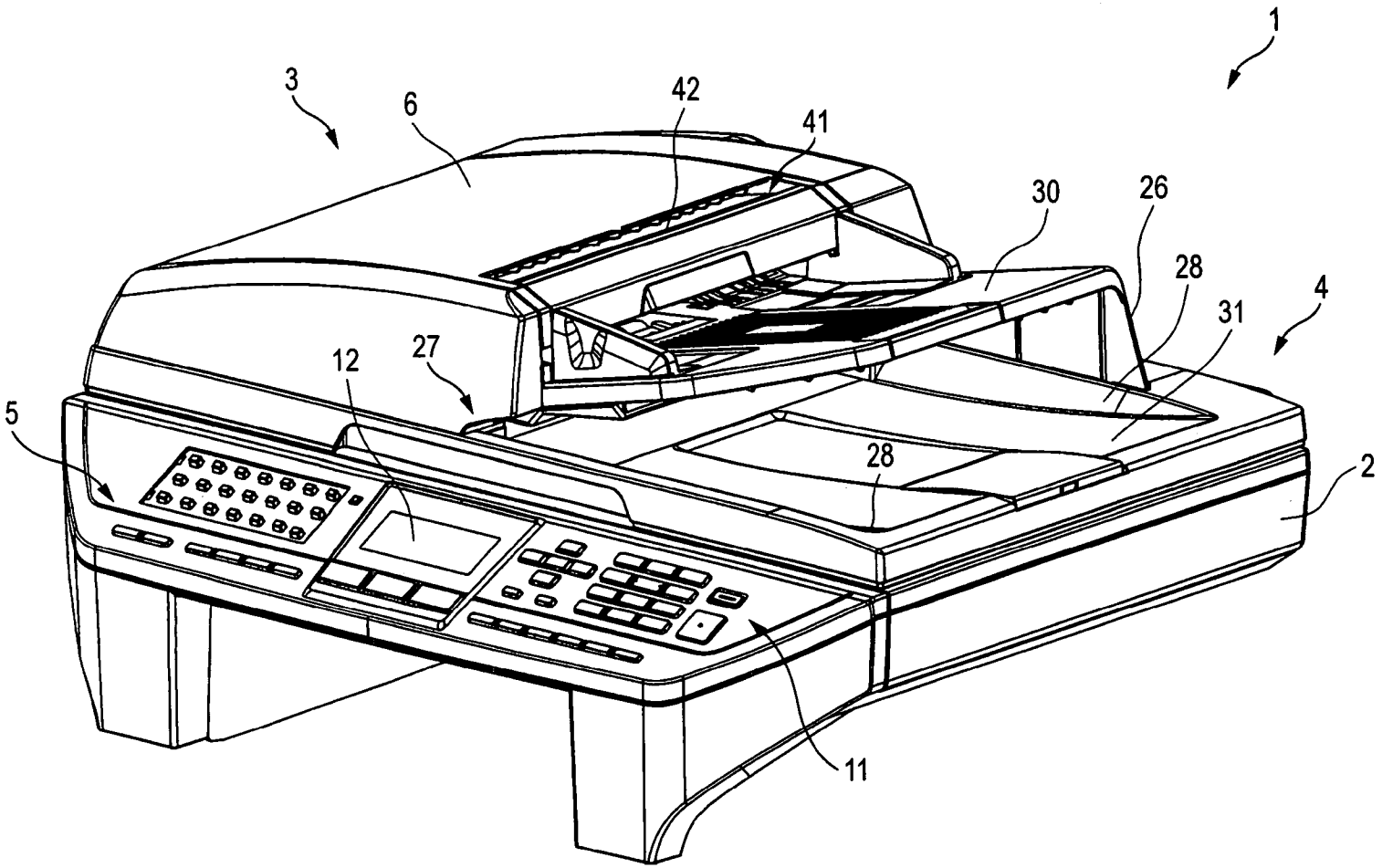
FIG. 1 is a perspective view illustrating an outer configuration of an image reading apparatus according to an aspect of the present invention.
Figure 2:
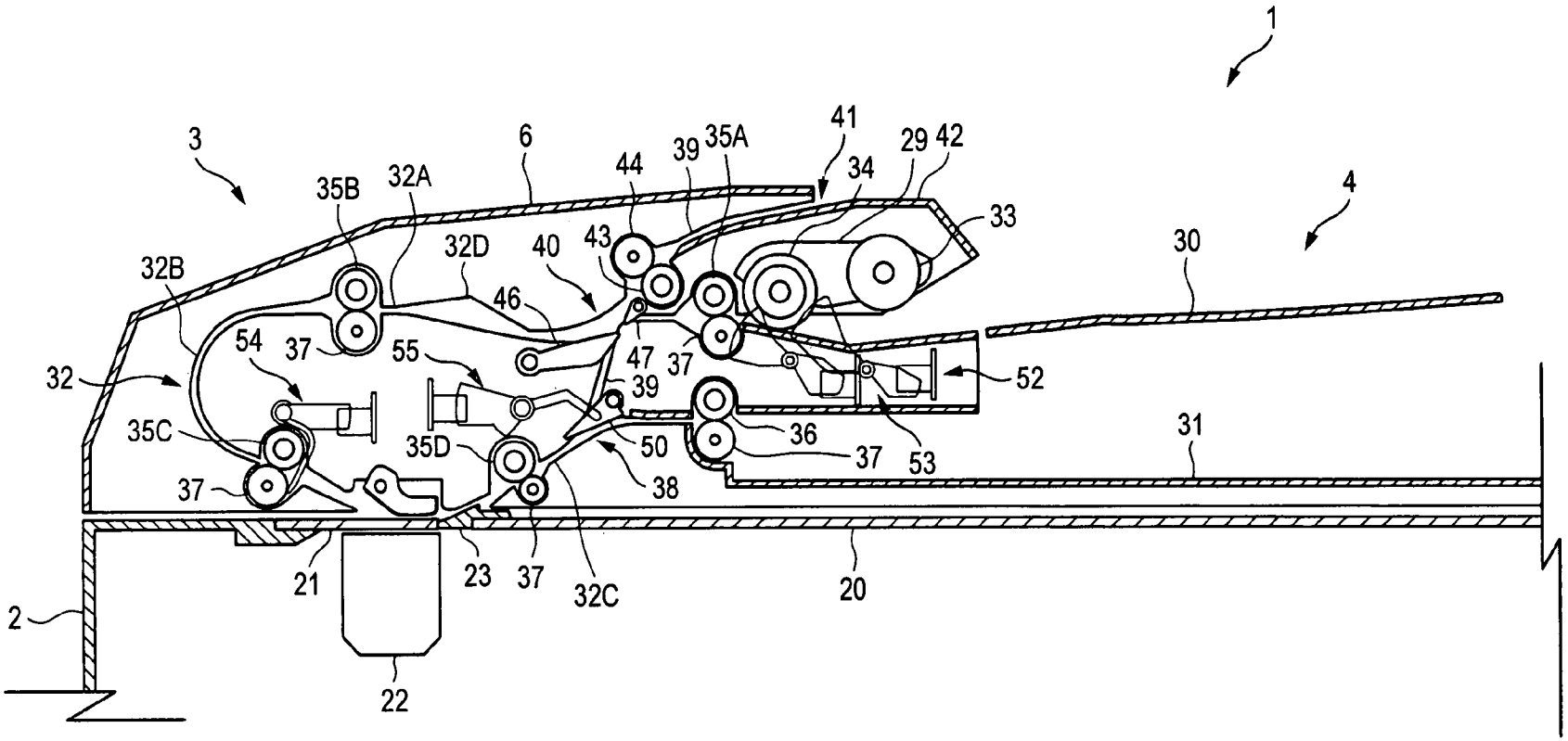
FIG. 2 is a longitudinal sectional view illustrating an inner configuration of the image reading apparatus.

FIGS. 1 and 2 show a configuration of an image reading apparatus 1 according to an aspect of the invention. The image reading apparatus 1 is embodied as an image scanner for scanning an image of a document, for example, in a copier, a facsimile, a scanner, and a multifunction device (MFD) integrally having a copying function, a facsimile function, and a scanning function.

As shown in FIGS. 1 and 2, in the image reading apparatus 1, a document cover 4 including an ADF is mounted to a document placing table 2 serving as a flatbed scanner (FBS)

so as to be opened and closed via a hinge (not shown) on the rear side of the image reading apparatus as shown in FIG. 1.

An operation panel 5 is provided on the front side of the document placing table 2. The operation panel 5 includes a variety of operation keys 11 and a liquid crystal display unit 12. A user inputs a desired instruction through the operation panel 5. The image reading apparatus 1 performs a predetermined operation in response to the input. The image reading apparatus 1 may operate in response to instructions transmitted through a printer driver or a scanner driver of a computer connected thereto, as well as to instructions input through the operation panel 5.

As shown in FIG. 2, in the document placing table 2, platen glass 20 and 21 are disposed on the top surface opposed to the document cover 4. When the document cover 4 is opened, the platen glass 20 and 21 are exposed as a top surface of the document placing table 2. When the document cover 4 is closed, the entire top surface of the document placing table 2 including the platen glass 20 and 21 is covered. An image reader 22 is built into the document placing table 2 so as to be opposed to the platen glass 20 and 21.

When the image reading apparatus 1 is used as an FBS, a document is placed on the platen glass 20 which is formed of, for example, a transparent glass plate. An opening for exposing the platen glass 20 is formed at the center of the top surface of the document placing table 2 and an area of the platen glass 20 exposed through the opening serves as a document scanning area of the FBS.

The platen glass 21 serves as a scanning position when the image reading apparatus 1 employs an ADF 3 and the platen glass 21 is formed of, for example, a transparent glass plate. An opening for exposing the platen glass 21 is formed at the scanning position of the document placing table 2. The platen glass 21 exposed through the opening extends in the rear direction of the image reading apparatus 1 to correspond to the length in the main scanning direction of the image reader 22.

A positioning member 23 is disposed between the platen glass 20 and the platen glass 21. The positioning member 23 is a longitudinal plate member extending in the rear direction of the image reading apparatus 1, similar to the platen glass 21. The positioning member 23 is used as a reference for positioning a document when the document is placed onto the platen glass 20 which is a document placing table in the FBS. The leading end of all documents fed to the platen glass 21 are positively caught and deflected upwardly by an upper surface of the positioning member 23 into the next feed nip (which is the feed roller nip 35D and 37).

The image reader 22 is a line image sensor irradiating light to a document through the platen glass 20 and 21 from a light source, collecting the light, which is reflected from the document, on a light receiving element with a lens, and then converting the received light into an electrical signal. The image reader 22 scans the images of the document fed on the platen glass 21 by the ADF 3 by using the width direction of the feed path 32 of the ADF 3 as a scanning line. For example, a close CIS image sensor or a CCD image sensor of a reduced optical system can be used as the image reader 22. The image reader 22 is disposed so as to reciprocate below the platen glass 20 and 21 by means of a belt driving mechanism as a scanning mechanism and reciprocates parallel to the platen glass 20 and 21 with the driving power of a motor.

The document cover 4 is provided with the ADF 3 subsequently feed documents to the output tray 31 (output section) through the feed path 32 from the input tray 30 (loading section). In the course of the feed operation of the ADF 3, the document passes through the scanning position on the platen glass 21 and the image reader 22 disposed below the platen glass 21 scans the images of the document.

As shown in FIGS. 1 and 2, the input tray 30 and the output tray 31 are disposed in the document cover 4 in two layers using the input tray 30 as the upper layer. A document of which images should be scanned by the ADF 3 is placed on the input tray 30. A plurality of documents is placed on the input tray so that the leading ends in the feed direction can be inserted into the feed path 32 in a state where the first sides are arranged upward. A barrier wall 26 is formed by bending the rear side of the input tray 30 downwardly. The lower end of the barrier wall 26 is connected to the top surface of the document cover 4. When the document cover 4 is opened from the document placing table 2, the barrier wall 26 prevents the documents on the output tray 31 from dropping. On the front lower side of the input tray 30, a notch 27 is formed in a part of a case body of the ADF 3. The visibility of the document unloaded onto the output tray 31 as viewed from the front side is enhanced. Specifically, since a small-sized document is not visible due to obstruction by the input tray 30 but the space between the input tray 30 and the output tray 31 is widened by the notch 27, the visibility of the small-sized document is particularly increased.

The output tray 31 is positioned below the input tray 30 and is formed integrally with the top surface of the document cover 4. The document scanned and unloaded from the ADF3 is piled on the output tray 31 with the first side facing downward input tray. Both side portions 28 of the output tray 31 which are the front and rear sides of the device have sides inclined upward. When the document onto the output tray 31 is taken out, the document can be taken out by pressing the document from the top surface by the use of the both side portions 28 and allowing the document to slide along the inclined sides of both side portions 28

As shown in FIG. 2, the document feed path 32 has a substantial U shape in the lateral direction as viewed in the longitudinal section. The document feed path 32 is formed inside the ADF 3 so that the input tray 30 and the output tray 31 are connected to each other through the scanning position on the platen glass 21. The document feed path 32 is continuously formed as a passage having a predetermined width, through which the document can pass, by elements constituting the ADF, guide plates, and guide ribs. In this way, by disposing the input tray 30 and the output tray 31 in a vertically two-stepped structure and forming the document feed path 32 having a substantially lateral U shape as viewed in the longitudinal section so as to connect the trays to each other, it is possible to narrow the ADF 3 and to decrease the size thereof.

The document feed path 32 has a substantially lateral U shape extending toward one end (the left side in FIG. 2) of the document cover 4 from the input tray 30, being curved downwardly, and reaching the scanning position on the platen glass 21, as viewed in a longitudinal section extending from the scanning position toward the output tray 31. The document feed path 32 includes an upper portion 32A and a lower portion 32C forming two straight-line portions of the U shape, and a curved portion 32B curved to connect the upper portion 32A and the lower portion 32C. A space 32D in which a document Gn can be looped is formed in the upper portion 32A of the document feed path 32. The document feed path 32 is used as a document feed path common to single-sided scanning and double-sided scanning as performed by the image reading apparatus 1 with ADF 3.

A document feed unit for feed a document from the input tray 30 to the output tray 31 is disposed in the document feed path 32. Specifically, as shown in FIG. 2, the document feed unit includes a pick-up roller 33, a separation roller 34, feed rollers 35A, 35B, 35C, and 35D, a discharge roller 36, and a pinch roller 37 formed in the document feed path 32. The driving power is delivered to the rollers constituting the document feed unit from a motor 67 (see FIG. 6) as a drive source.

As shown in FIG. 2, the pick-up roller 33 and the separation roller 34 are formed on the most upstream side of the document feed path 32. The pick-up roller 33 is rotatably disposed in an end portion of an arm 29 of which the base end is supported by a shaft axially supporting the separation roller 34. The separation roller 34 is spaced apart from the pick-up roller 33 in the document feed direction and is disposed to rotatably abut on the opposed surface of the document feed path 32. The pick-up roller 33 and the separation roller 34 rotate with the driving power from the motor 67 and the arm 29 also moves upwardly and downwardly with the driving power from the motor 67. The pick-up roller 33.and the separation roller 34 have the same diameter and rotate at the same circumferential velocity. A separation pad for separating the documents with a friction resulting from the abutment on the roller surface of the separation roller 34 is disposed at the opposed position of the separation roller 34.

The feed rollers 35A, 35B, 35C, and 35D are disposed at different positions in the document feed path 32. In this aspect, the feed roller 35A is disposed on the downstream side in the feed direction adjacent to the separation roller 34. The feed roller 35B is disposed in the upper portion 32A of the document feed path 32. The feed roller 35C is disposed in the lower portion 32C of the document feed path 32 and on the upstream side in the feed direction adjacent to the scanning position. The feed roller 35D is disposed in the lower portion 32C of the document feed path 32 and on the downstream side in the feed direction adjacent to the scanning position.

Pinch rollers 37 are disposed at the opposed positions of the feed rollers 35A, 35B, 35C, and 35D, respectively, to form roller pairs. The pinch rollers 37 abut the roller sides of the feed rollers 35A, 35B, 35C, and 35D forming the pairs, respectively, by resiliently urging together the shafts of each roller pair with springs. When the feed rollers 35A, 35B, 35C, and 35D rotate, the pinch rollers 37 also accordingly rotate in response. The document is nipped to be pressed on the feed rollers by the pinch rollers 37, with rotary power of the feed rollers 35A, 35B, 35C, and 35D being delivered to the document, and thus the document is fed in the rotation direction of the feed rollers 35A, 353, 35C, and 35D.

Among the feed rollers 35A, 3S, 35C, and 35D and the pinch rollers 37 forming the pairs, the feed roller 35D and the pinch roller 37 disposed on the downstream side in the feed direction adjacent to the scanning position correspond to a first transfer element. The feed roller 35B and the pinch roller 37 disposed on the upstream side in the feed direction adjacent to the scanning position correspond to a third transfer element. The positions of the other feed rollers 35A and 35C shown in FIG. 2 are an example only and the number and the positions of feed rollers disposed in the document feed path 32 may be properly changed without departing from the scope of the invention.

The document discharge roller 36 is disposed at a location farthest downstream in the document feed path 32 and rotates with the driving power delivered from the motor 67, similar to the feed rollers 35A, 35B, 35C, and 35D. A pinch roller 37 is disposed at the opposed position of the document discharge roller 36 and the pinch roller 37 is resiliently urged with a spring so as to be contacted with the document discharging roller 36.

A bidirectional feed path 39 feed is connected to a connection position 38 of the lower portion 32C of the document feed path 32. When the double-sided scanning is performed, the bidirectional feed path 39 serves to reverse the leading end and the trailing end of a document of which the first side is scanned at the scanning position and return the document to the upstream side adjacent to the scanning position from the downstream side in the document feed path 32. The bidirectional feed path 39 extends upwardly from the connection position 38 to the upper side of the input tray 30 and intersects the upper portion 32A of the document feed path 32. The document fed in a manner from the intersection position 40 between the upper portion 32A and the bidirectional feed path 39 is returned to the document feed path 32.

An end 41 of the bidirectional feed path 39 is opened in the outer surface of the ADF 3. A document supporting portion 42 is formed from the end 41 of the bidirectional feed path 39 to the input tray 30 to extend continuously from the end. The document supporting portion 42 serves to support a document protruding from the end 41 of the bidirectional feed path 39 and forms an upper cover 6 of the ADF 3 above the pick-up roller 33 and the separation roller 34. The upper cover 6 covers the entire ADF 3 including the pick-up roller 33 and the separation roller 34 and forms a housing (device case body) of the ADF 3. The document supporting portion 42 constructed as the upper cover 6 extends from the end 41 toward the input tray 30 until it reaches the upstream side adjacent to a loading position defined by the pick-up roller 33 and the separation roller 34.

A reversible roller 43 is disposed closer to the end 41 than the intersection position 40 in the bidirectional feed path 39. The reversible roller 43 rotates in two directions of a forward direction and a backward direction with the driving power delivered from the motor 67. A pinch roller 44 is disposed at a position to the reversible roller 43. The pinch roller 44 is pressed on the roller surface of the reversible roller 43 by resiliently urging the shaft with a spring and rotates with the rotation of the reversible roller 43. The force resiliently urging the pinch roller 44 to the reversible roller 43 is set smaller than the force resiliently urging the pinch roller 37 to the feed roller 35D. Accordingly, the reversible roller 43 and the pinch roller 44 nip the document with a nip pressure smaller than that of the feed roller 35D and the pinch roller 37. The document is pressed to the reversible roller 37 and nipped by the pinch roller 44, the rotary power of the reversible roller 43 is delivered to the document, and the document is fed in the rotation direction of the reversible roller 43.

In this aspect, the bidirectional feed path 39 connected to the connection position 38 downstream from the scanning position in the document feed path 32 is allowed to intersect the upper portion 32A of the document feed path 32 and the reversible roller 43 is disposed closer to the end 41 than the intersection position 40. However, the feed path of the switchback path 39 is arbitrary and the feed path of the bidirectional feed path may be properly modified if only it can reverse the leading end and the trailing end of the document and return the document to the side upstream of the scanning position from the side downstream of the scanning position.

Figure 3:
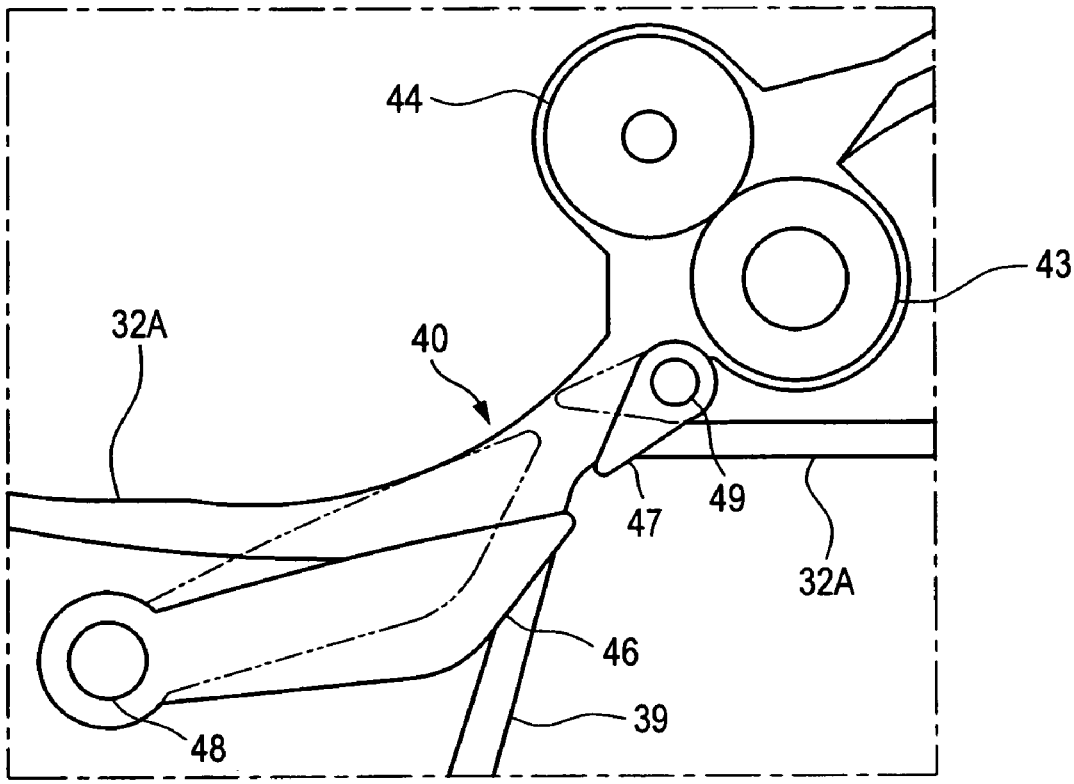
FIG. 3 is an enlarged view illustrating a configuration of an intersection position.

As shown in FIGS. 2 and 3, a guide flap 46 and a guide flap 47 for guiding the document to a desired feed path are disposed at the intersection position 40. The guide flap 46 is disposed to be pivotable about the shaft 48 disposed at the corner (left-lower side in FIG. 3) on the scanning position side in the document feed path 32 about the intersection position 40 and the connection position 38 side of the bidirectional feed path 39 within a predetermined range. The guide flap 46 is formed of a wing-shaped plate and the end protrudes from the intersection position 40. Only one guide flap 46 is shown in the figure, but a plurality of guide flaps 46 having the same shape are disposed in the width direction (a direction perpendicular to the paper plane of FIG. 3, the rear direction of the device) of the document feed path 32 at a predetermined interval and the plurality of guide flaps 46 pivot integrally.

The guide flaps 46 are switched between a third guiding posture indicated by a solid line in FIG. 3 and a fourth guiding posture indicated by a two-dot chained line by rotating about the shaft 48. By abutting on, for example, a guide member of the document feed path 32 or the bidirectional feed path 39, the guide flaps 46 are suppressed from rotation from the third guiding posture downwardly in the figure and rotation from the fourth guiding posture upwardly in the figure. By setting the guide flaps 46 to the third guiding posture, the feed path from the input tray 30 side (the right side in FIG. 3) in the document teed path 32 to the scanning position (the left side in FIG. 3) is continuously activated and the feed path from the document feed path 32 to the connection position 38 side (the lower side in FIG. 3) of the bidirectional feed path 39 is deactivated. Accordingly, the document reaching the intersection position 40 from the input tray 30 side of the document feed path 32 is allowed to enter the scanning position of the document feed path 32 and is suppressed from entering the connection position 38 of the bidirectional feed path 39. The document reaching the intersection position 40 from the end 41 side (the upper side in FIG. 3) of the bidirectional feed path 39 is allowed to enter the scanning position of the document feed path 32 and is suppressed from entering the connection position 38 of the bidirectional feed path 39.

By setting the guide flaps 46 to the fourth guiding posture, the feed path from the connection position 38 side of the bidirectional feed path 39 to the end 41 side is continuously activated and the feed path from the connection position 38 side of the bidirectional feed path 39 to the scanning position side of the document feed path 32 is deactivated. Accordingly, the document reaching the intersection position 40 from the connection position 38 side of the bidirectional feed 39 is allowed to enter the end 41 side of the bidirectional feed 39 and is suppressed from entering the scanning position of the document feed path 32.

The switching of the feed path by the guide flaps 46 biased so as to be located at the positioned in the third guiding posture indicated by the solid line in FIG. 3 by its own weight or as a result of undergoing an urging force, such as from an elastic member such as a spring. When a document being fed on the bidirectional feed path 39 from the connection position 38 to the intersection position 40 comes in contact with the guide flaps 46, the guide flaps 46 are pivoted upward in the figure and to the fourth posture indicated by the two-dot chained line in FIG. 3. On the other hand, when a document fed from the termination 41 to the intersection position 40 on the bidirectional feed path 39, it comes in contact with the guide flaps 46. However, as the guide flap 46 is regulated so that it does not move downward from the position in the figure from the third guiding posture, the document is guided by the guide flaps 46 to enter the scanning position through the upper portion 32A of the document feed path 32. The wing shape of the guide flaps 46 employs a shape which can be easily varied in posture by the abutment on the document fed from the connection position 38 side of the bidirectional feed path 39 to the intersection position 40 and which allow the document fed from the end 41 of the bidirectional feed 39 to the intersection position 40 to be easily guided to the scanning position of the document feed path 32. In this way, when the posture of the guide flaps 46 is allowed to vary by the abutment on the document, it is not necessary to actively vary the posture of the guide flaps 46 with the driving power delivered from the motor 67. Accordingly, it is possible to implement the guide flaps 46 with a simple configuration.

A guide flap 47 is disposed to be pivotable about a shaft 49 disposed at the corner (right-upper side in FIG. 3) on the input tray 30 side of the document feed path 32 adjacent to the intersection position 40 and near the end 41 side of the bidirectional feed path 39 within a predetermined range. The guide flap 47 is formed of a wing-shaped plate with an end protruding from the intersection position 40. Only one guide flap 47 is shown in the figure, but a plurality of guide flaps 47 having the same shape are disposed in the width direction of the document feed path 32 at a predetermined interval and the plurality of guide flaps 47 pivot integrally.

The guide flaps 47 are switched between a fifth guiding posture indicated by a solid line in FIG. 3 and a sixth guiding posture indicated by a two-dot chained line by rotating about the shaft 49. By abutting on, for example, a guide member of the document feed path 32 or the bidirectional feed path 39, the guide flaps 47 are suppressed from rotation from the fifth guiding posture downwardly in the figure and rotation from the sixth guiding posture upwardly in the figure. By setting the guide flaps 47 to the fifth guiding posture, the feed path from the end 41 side of the bidirectional feed path 39 to the scanning position of the document feed path 32 is continuously activated and the feed path from the connection position 38 side of the bidirectional feed path 39 to the input tray 30 side of the document feed path 32 is deactivated. Accordingly, the document reaching the intersection position 40 from the end 41 side of the bidirectional feed path 39 is allowed to enter the scanning position of the document feed path 32 and is suppressed from entering the input tray 30 side. The document reaching the intersection position 40 from the connection position 38 of the bidirectional feed path 39 is allowed to enter the end 41 side of the bidirectional feed path 39 and is suppressed from entering the input tray 30 side of the document feed path 32.

By setting the guide flaps 46 to the sixth guiding posture, the feed path from the input tray 30 side of the document feed path 32 to the scanning position side is continuously activated and the feed path from the input tray 30 side of the document feed path 32 to the end 41 side of the bidirectional feed path 39 is deactivated. Accordingly, the document reaching the intersection position 40 from the input tray 30 side of the document feed path 32 is allowed to enter the scanning position of the document feed path 32 and is suppressed from entering the end 41 side of the bidirectional feed path 39.

The switching of the feed path by the guide flaps 47 is performed by means of the abutment on the document. The guide flap 47 is typically positioned in the fifth guiding posture indicated by the solid line in FIG. 3 by its own weight or by the urging force of a resilient member such as a spring. By allowing the document fed from the input tray 30 side of the document feed path 32 to abut on the guide flaps 47, the guide flaps 47 are pushed to pivot to the left side in the figure and to the sixth posture indicated by the two-dot chained line in FIG. 3. On the other hand, when the document fed from the connection position 38 side of the bidirectional feed path 39 to the intersection position 40 abuts on the guide flaps 47, the guide flaps 47 are suppressed from rotating to the right side in the figure from the fifth guiding posture. Accordingly, the document is guided by the guide flaps 47 to enter the end 41 side of the bidirectional feed path 39. The wing shape of the guide flaps 47 employs a shape which can be easily varied in posture by the abutment on the document fed from the input tray 30 side of the document feed path 32 to the intersection position 40 and which allow the document fed from the connection position 38 side of the bidirectional feed path 39 to the intersection position 40 to be easily guided to the end 41 side of the bidirectional feed path 39. In this way, when the posture of the guide flaps 47 is allowed to vary by the abutment on the document, it is not necessary to actively vary the posture of the guide flaps 47 with the driving power delivered from the motor 67. Accordingly, it is possible to implement the guide flaps 47 with a simple configuration.

Figure 4:
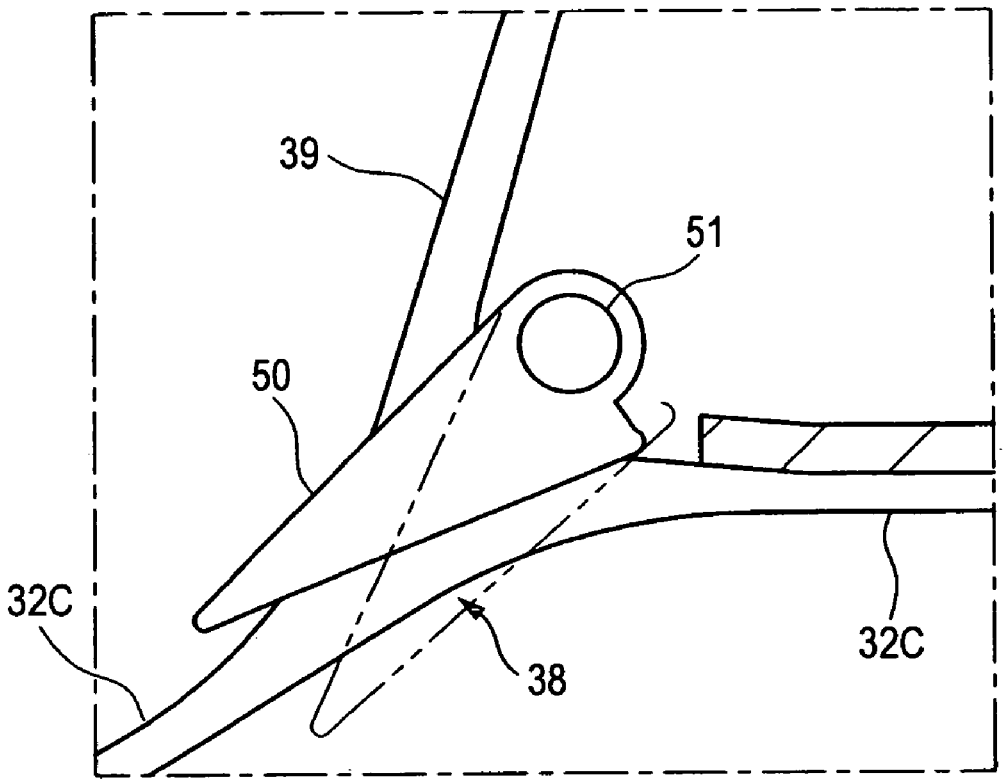
FIG. 4 is an enlarged view illustrating a configuration of a connection position.

As shown in FIGS. 1 and 4, a guide flap 50 is disposed at the connection position 38. The guide flap 50 is disposed to be rotatable about a shaft 51 and pivots between a first guiding posture indicated by a solid line in FIG. 4 and a second guiding posture indicated by a two-dot chained line with the driving power delivered from the motor 67. By abutting on, for example, a guide member of the document feed path 32 or the bidirectional feed path 39, the guide flap 50 is pushed by the document being fed in the document feed path from the first guiding posture and rotation from the second guiding posture downwardly in the figure. When the guide flap 50 is in the first guiding posture, the feed path from the scanning position side (the left side in FIG. 4) of the document feed path 32 to the output tray 31 side (the right side in FIG. 4) is continuously activated. Accordingly, the document being fed through the scanning position is guided to the lower portion 32C of the document feed path 32 at the connection position 38 toward the output tray 31. When the guide flap 50 is in the second guiding posture, the feed path from the downstream side of the lower portion 32C of the document feed path 32 about the scanning position to the bidirectional feed path 39 is continuously activated. Accordingly, the document being fed through the scanning position is guided at the connection position 38 to enter the bidirectional feed path 39. In this way, the guide flap 50 is disposed to guide the document at the connection position 38 to any one of the document feed path 32 and the bidirectional feed path 39. In the figure, only one guide flap 50 is shown, but a plurality of guide flaps 50 having the same shape are formed in the width direction of the document feed path 32 with a predetermined interval and the plurality of guide flaps 50 integrally pivot.

As shown in FIG. 2, a plurality of sensors for sensing the feed of the document is disposed in the document feed path 32 and the bidirectional feed path 39. Specifically, a front sensor 52 and a second front sensor 53 are disposed on the upstream side and the downstream side respectively of the separation roller 34 in the document feed path 32 and a rear sensor 54 is disposed on the upstream side of the scanning position. A switch-back sensor 55 is disposed between the connection position 38 of the bidirectional feed path 39 and the intersection position 40. Since the sensors may be optical sensors and have the same configuration except that the shapes of detectors are different from each other depending on difference in detection positions, the configuration is described using the front sensor 52 as an example.

Figure 5:
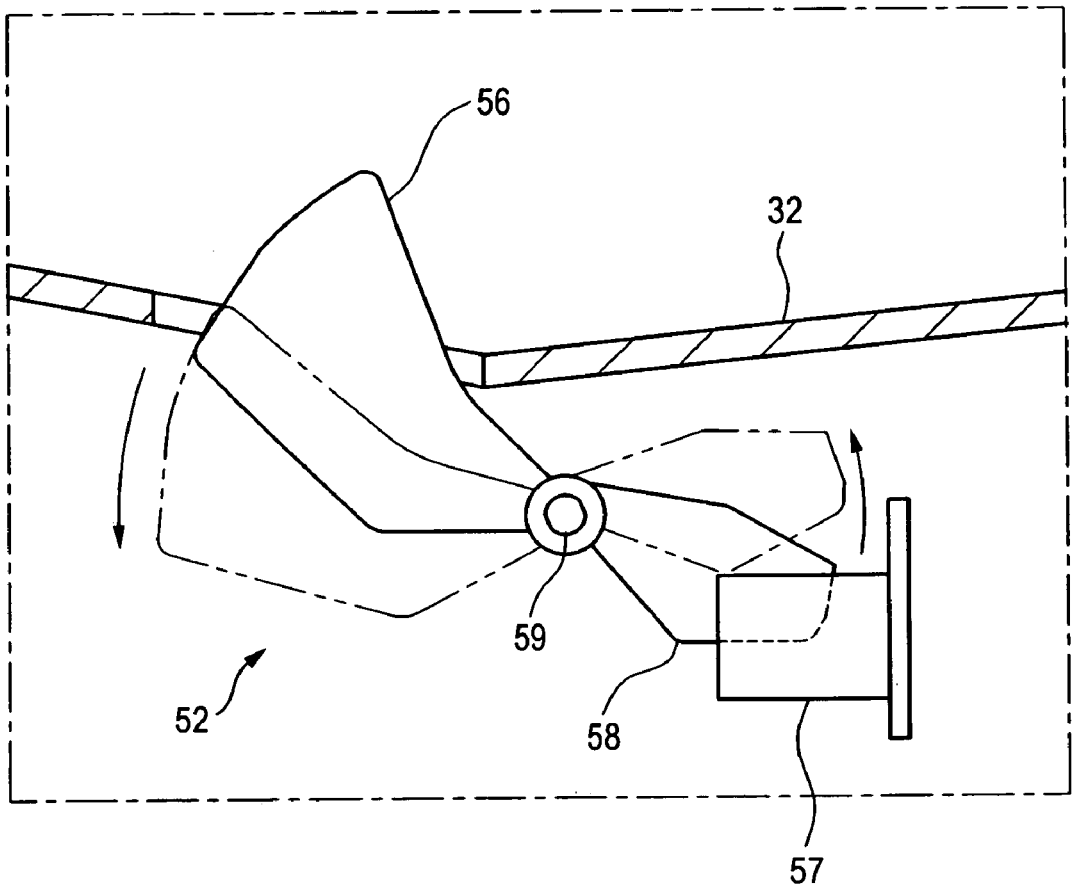
FIG. 5 is an enlarged view illustrating a configuration of a first front sensor.

As shown in FIG. 5, the front sensor 52 includes a detector 56, which protrudes from the bottom surface of the document feed path 32 and rotates to retreat from the document feed path 32 when contacting the document, and a photo interrupter 57 detecting the rotation of the detector 56, as shown in FIG. 5. A shield portion 58 sensed by the photo interrupter 57 is formed integrally with the detector 56 and is rotatable about a shaft 59. The detector 56 is resiliently urged by an urging member such as a spring (not shown) to a position where the detector 56 protrudes into the document feed path 32, that is, in the clockwise direction in the example shown in FIG. 5. In a state where no external force act on the detector 56, the detector 56 protrudes into the document feed path 32 as indicated by a solid line in the figure and the shield portion 58 is interposed between a light-emitting portion and a light-receiving portion of the photo interrupter 57. Accordingly, the light delivery of the photo interrupter 57 is hindered, thereby turning off the first front sensor 62.

When a document is placed on the input tray 30, the document abuts the detector 56 and compels the detector 56 to rotate so as to retreat from the document feed path 32. The shield portion 58 is also allowed to rotate along with the detector 56 and the shield portion 58 is moved from being between the light-emitting portion and the light-receiving portion of the photo interrupter 57 as indicated by a two-dot chained line in FIG. 5. Accordingly, the light delivery of the photo interrupter 57 is not hindered, thereby turning on the first front sensor 52. It is detected on the basis of the On/Off state of the first front sensor 52 whether a document is placed on the input tray 30.

The second front sensor 53 disposed on the immediate downstream side of the separation roller 34 serves to sense the leading end or the trailing end of the document fed to the document feed path 32 on the basis of the On/Off state thereof. For example, by monitoring the number of rotations of the feed rollers 35A, 35B, 35C, and 35D by the use of an encoder or the number of steps of the motor 67 after the second front sensor 53 senses the trailing end of the document, a position of the leading end or the trailing end of the document in the document feed path 32 is judged.

The rear sensor 54 disposed upstream from the scanning position serves to sense the leading end and the trailing end of the document fed in the document feed path 32 on the basis of the On/Off state thereof. By monitoring the number of rotations of the feed rollers 35A, 35B, 35C, and 35D by the use of an encoder or the number of steps of the motor 67 after the rear sensor 54 senses the leading end or the trailing end of the document, it is judged whether the leading end or the trailing end of the document reaches the scanning position. The image scanning of the image scanning unit 22 is controlled on the basis of the signal from the rear sensor 54. When the leading end of the document reaches the scanning position, the image scanning is started and when the trailing end of the document reaches the scanning position, the image scanning is ended.

The switch-back sensor 55 disposed between the connection position 38 of the bidirectional feed path 39 and the intersection position 40 serves to sense the leading end or the trailing end of the document fed in the bidirectional feed path 39 on the basis of the On/Off state thereof. For example, by monitoring the number of rotations of the feed rollers 35A, 35B, 35C, and 35D and the reversible roller 43 by the use of an encoder or the number of steps of the motor 67 after the switch-back sensor 55 senses the trailing end of the document, it is judged whether the trailing end of the document passes through the intersection position 40.

Figure 6:
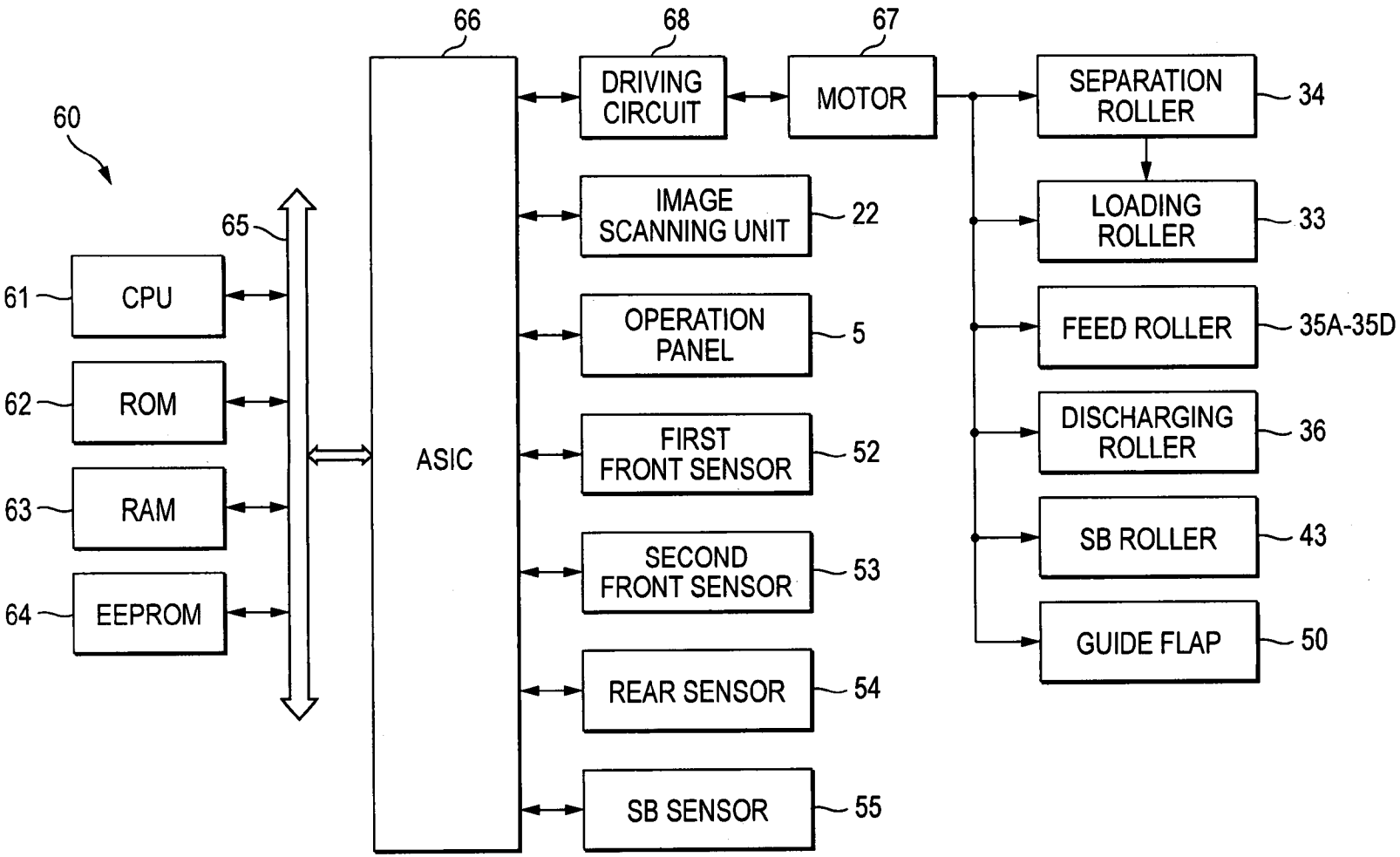
FIG. 6 is a block diagram illustrating a configuration of a control unit.

FIG. 6 illustrates a configuration of a control unit 60 of the image reading apparatus 1. As shown in FIG. 6, the control unit 60 is composed of a micro computer mainly including a CPU 61, a ROM 62, a RAM 63, and an EEPROM (Electrically Erasable and Programmable ROM) 64 and is connected to an ASIC (Application Specific Integrated Circuit) 66 through a bus 65.

Programs or the like for controlling a variety of operations of the image reading apparatus 1 are stored in the ROM 62. The RAM 63 is used as a memory area or a work area for temporarily storing a variety of data used for the CPU 61 to execute the programs. The EEPROM 64 is a memory area for storing a variety of settings or flags which should be stored even after the power source is turned off.

The ASIC 66 controls the rotation of the motor 67 by generating a phase excitation signal or the like for turning on the motor 67 in accordance with an instruction from the CPU 61, sending the signal to the driving circuit 68 of the motor 67, and turning on the motor 67 through the driving circuit 68. The motor 67 delivers the driving power to the pick-up roller 33, the separation roller 34, the feed rollers 35A, 35B, 35C, and 35D, the discharge roller 36, the reversible roller (SB roller) 43, and the guide flap 50 by means of forward and backward rotations thereof and serves as a driving source in the ADF 3.

The driving circuit 68 drives the motor 67 and generates an electrical signal for operating the motor 67 from the output signal of the ASIC 66. In response to the electrical signal, the motor 67 rotates at a predetermined circumferential velocity in a predetermined rotation direction and the rotary power of the motor 67 is delivered to the pick-up roller 33, the separation roller 34, the feed rollers 35A, 35B, 35C, and 35D, the discharge roller 36, the reversible roller 43, and the guide flap 50 through a driving power delivery mechanism.

An image scanning unit 22 scanning an image of a document fed to the scanning position by the ADF 3 is connected to the ASIC 66. The image scanning unit 22 scans the image of the document on the basis of a control program stored in the ROM 62. Although not shown in FIG. 6, a driving mechanism allowing the image scanning unit 22 to reciprocate is activated in response to the output signal of the ASIC 66.

The first front sensor 52, the second front sensor 53, the rear sensor 54, and the switch-back sensor (SB sensor) 55 are connected to the ASIC 66. The CPU 61 receives the On/Off signals of the sensors and outputs a predetermined output signal to the ASIC 66 on the basis of the control program stored in the ROM 62 so as to activate the motor 67 or the image scanning unit 22.

By delivering the rotary power of the motor 67 to the pick-up roller 33, the separation roller 34, the feed rollers 35A, 35B, 35C, and 35D, the discharge roller 36, the reversible roller 43, and the guide flap 50 through the driving power delivery mechanism, the rollers rotate at predetermined circumferential velocity. As described above, the document is fed in the document feed path 32 or the bidirectional feed path 39 at a predetermined feed speed in accordance with the circumferential velocity of the rollers.

In the feed rollers 35A and 35B, the circumferential velocity of the feed roller 35A is set greater than the circumferential velocity of the feed roller 35B. That is, when it is assumed that the circumferential velocity of the feed roller 35A is Va and the circumferential velocity of the feed roller 35B is Vb, the relation of Va>Vb is established. Accordingly, when a document is fed by the feed rollers 35A and 35B, the document is fed to be looped between the feed rollers 35A and 35B.

In the feed rollers 35B, 35C, and 35D, the circumferential velocity of the feed roller 35C disposed on the upstream side adjacent to the scanning position is set smaller than the circumferential velocity of the feed rollers 35B and 35D. That is, when it is assumed that the circumferential velocity of the feed roller 35C is Vc and the circumferential velocity of the feed roller 35D is Vd, the relation of Vb>Vc<Vd is established. Accordingly, when a document is fed by the feed rollers 35B and 35C, the document is fed to be looped between the feed rollers 35B and 35C. When a document is fed by the feed rollers 35C and 35D, the document is fed to be drawn by the feed roller 35D.

In the relation between the feed roller 35D and the reversible roller 43, the circumferential velocity of the reversible roller 43 is set higher than the circumferential velocity of the feed roller 35D. That is, when it is assumed that the circumferential velocity of the reversible roller 43 is Vs, the relation of Vd<Vs is established. Accordingly, the document fed by the feed roller 35D is rapidly nipped by the reversible roller 43 and the pinch roller 44.

In the relation between the feed roller 35B and the reversible roller 43, the circumferential velocity of the reversible roller 43 is set higher than the circumferential velocity of the feed roller 35B. That is, when it is assumed that the circumferential velocity of the reversible roller 43 is Vs, the relation of Vb<Vs is established. Accordingly, the document fed by the feed roller 35B and the reversible roller 43 is fed to be looped between the feed roller 35B and the reversible roller 43.

The difference in circumferential velocity between the feed rollers 35B, 35C, and 35D and the reversible roller 43 can be set simply by the use of roller diameters of the rollers. That is, when it is assumed that the roller radii (distance from a roller shaft to a roller surface) of the feed rollers 35A, 35B, 35C, and 35D is Ra, Rb, Rc, and Rd, Ra>Rb should be established so as to satisfy the relation of Va>Vb. Rb>Rc<Rd should be established so as to satisfy the relation of Vb>Vc<Vd. Similarly, when it is assumed that the roller radius of the reversible roller 43 is Rs, Rd<Rs should be established so as to satisfy the relation of Vd<Vs. Rb<Rs should be established so as to satisfy the relation of Vb<Vs. Accordingly, the substantially constant-speed rotation can be delivered to the rollers through driving power delivery mechanism from the motor 67 and the circumferential velocity can be simply set by the use of the roller radii of the rollers.

The difference in circumferential velocity between the feed rollers 35B, 35C, and 35D and the reversible roller 43 is not limited to be set using the roller radii of the rollers, but other known methods such as adjusting a gear ratio of the driving power delivery mechanism delivering the driving power to the feed rollers 35B, 35C, and 35D and the reversible roller 43 from the motor 67 may be used.

Hereinafter, an image scanning operation of the image reading apparatus 1 will be described.

The image reading apparatus 1 may be used as the FBS or may employ the ADF 3. Since the FBS is only tangentially related to the invention, detailed description thereof will be omitted. When the ADF 3 is used, the document cover 4 is closed with respect to the document placing table 2. The opening and closing of the document cover 4 is sensed by a sensor disposed in the document cover 4 and when the document cover 4 is closed, the ADF 3 is usable. A document Gn to be scanned is placed on the input tray 30. The document Gn is placed on the input tray 30 in a state where a scanning surface (first side) is directed upward, that is, in a face-up state. The number of documents to be scanned may be one or more. For example, when a plurality of documents Gn having the same size are scanned, the documents are placed on the input tray 30 to overlap with each other in a state where the first side of a first document G1 is directed upward, that is, in the face-up state.

When the command for starting the scanning is input to the image reading apparatus 1, the motor 67 is driven to rotate the pick-up roller 33, the separation roller 34, the feed rollers 35A, 35B, 35C, and 35D, the discharge roller 36, and the reversible roller 43 at predetermined times. The arm 29 is lowered and thus the pick-up roller 33 is pressed against the document G1 on the input tray 30. Then, the documents are separated sheet by sheet, with the uppermost document G1 directly subjected to the rotation power of the pick-up roller 33 and the separation roller 34 and thus transferred to the document feed path 32. The fed document Gn is guided to the scanning position by the document feed path 32 and the image thereof is scanned by the image scanning unit 22 located below the scanning position. The document Gn of which the image has been scanned is unloaded onto the output tray 31. In the image scanning operation, the feed path of the document Gn varies in a single-sided scanning and a double-sided mode of scanning. It is determined, depending on the single-sided scanning mode or the double-sided scanning mode set in advance before the command for starting the scanning is input whether a single surface or both sides of the document Gn should be scanned.

Figure 7:
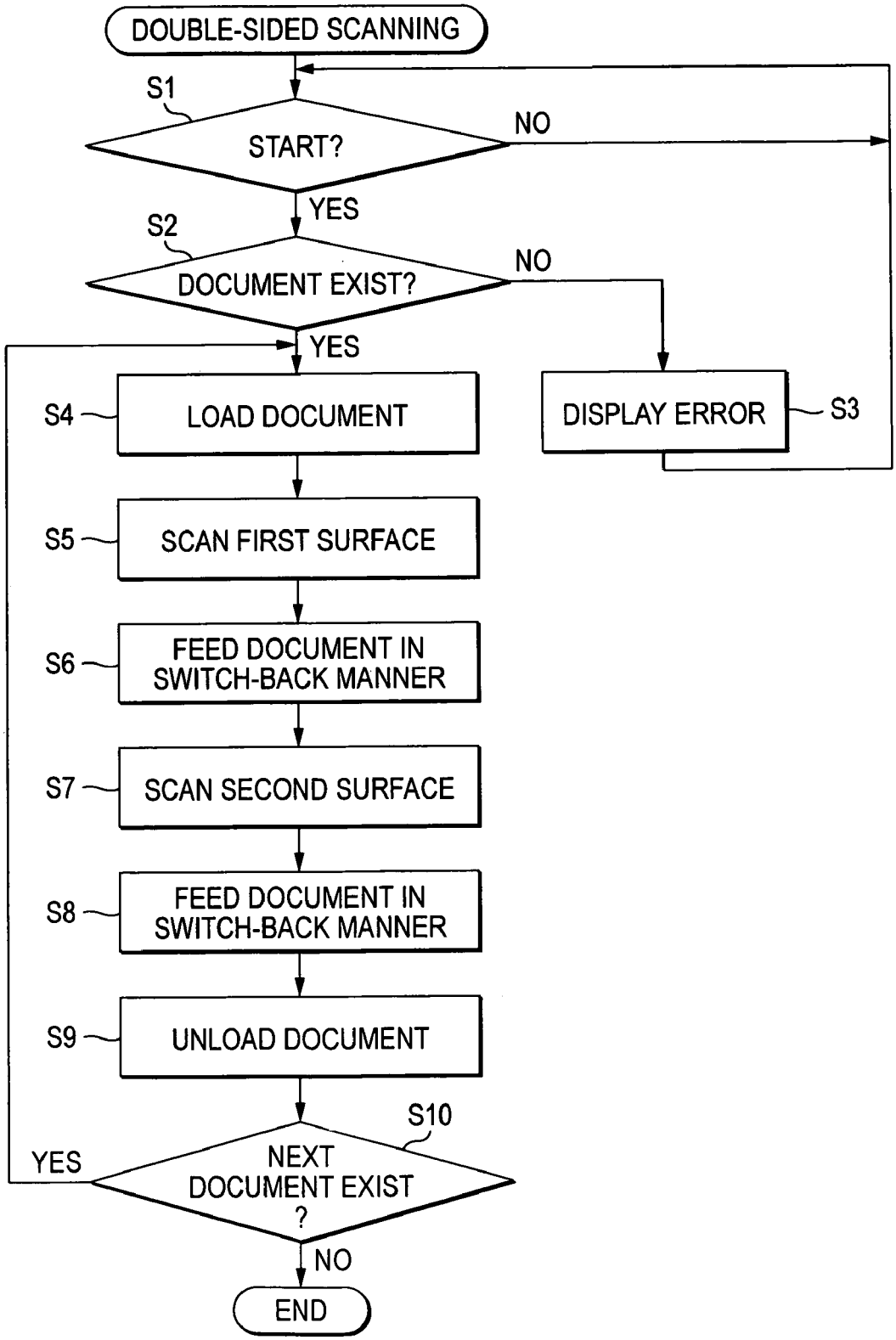
FIG. 7 is a flowchart illustrating a double-sided scanning operation of the image reading apparatus.
Figure 8:
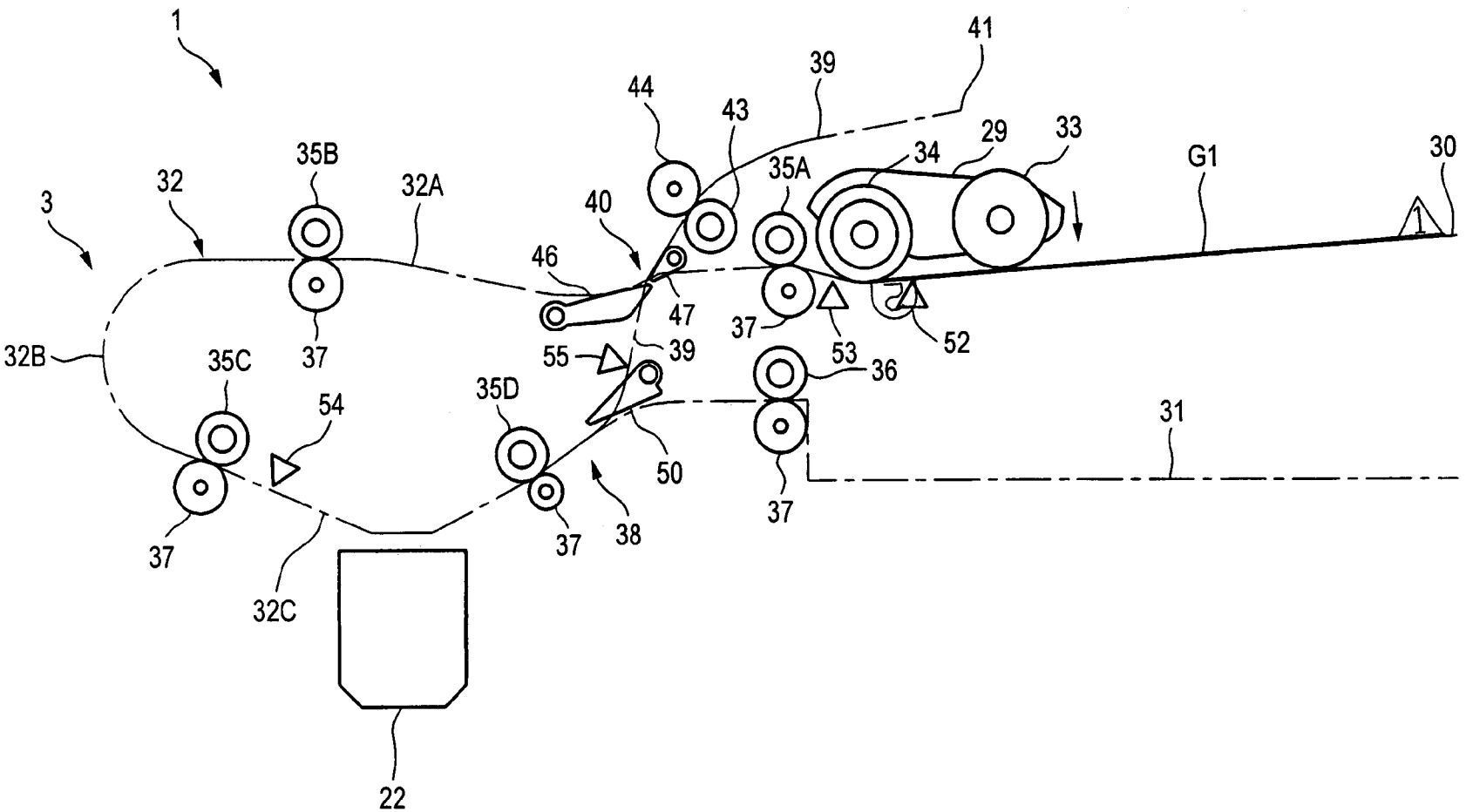
FIG. 8 is a schematic diagram illustrating a first image scanning operation in a double-sided scanning mode.

Hereinafter, the double-sided scanning mode will be described. FIG. 7 is a flowchart illustrating an operation of the image reading apparatus 1 in the double-sided scanning mode FIGS. 8 to 14 are schematic diagrams illustrating states where the document Gn is being fed in the double-sided scanning mode. Before loading the document Gn, as shown in FIG. 8, the guide flap 50 is disposed at a position where the feed path at the connection position 38 is continuous from the scanning position of the document feed path 32 to the output tray 31. The guide flap 46 is in the third guiding posture, that is, at a position where the feed path at the intersection position 40 is continuous from the input tray 30 side to the scanning position side and the guide flap 47 is in the fifth guiding posture, that is, at a position where the feed path at the intersection position 40 is continuous from the end 41 side of the bidirectional feed path 39 to the scanning position side of the document feed path 32. In the figures, the surface indicated by "1" in the document Gn is the first side first scanned at the time of double-sided scanning, the surface indicated by "2" is the second side later scanned, and the first side and the second side are front and back sides of the document.

When a command for starting the scanning is input to the image reading apparatus 1 (S1: Y), it is determined by the front sensor 52 whether a document Gn is placed on the input tray 30 (S2). When it is determined that no document Gn is placed on the input tray 30 (S2: N), the control unit 60 displays "no document" on the liquid crystal display unit 12 of the operation panel 5 of the image reading apparatus 1 (S3). When it is determined that a document Gn is placed on the input tray 30, the motor 67 is driven at a predetermined speed to load the document G1 (S4).

Specifically, the control unit 60 drives the motor 67 and lowers the arm 29. Accordingly, the pick-up roller 33 is pressed against the document G1 on the input tray 30. The driving power of the motor 67 is delivered to allow the pick-up roller 33 and the separation roller 34 to rotate in the feed direction and thus the document GI enters the document feed path 32. When a plurality of documents Gn is placed on the input tray 30, the document GI at the uppermost side and a document G2 immediately below may be loaded together, but the document G2 is hindered by the separation pad disposed at the opposed position of the separation roller 34.

In the document feed path 32, the driving power of the motor 67 is delivered to the feed rollers 35A, 35B, 35C, and 35D and the discharge roller 36 at a predetermined time and the rollers rotate so as to feed the document Gn from the upstream side to the downstream side in the document feed path 32, that is, in the feed direction. The document G1 fed from the input tray 30 to the document feed path 32 is nipped between the feed roller 35A and the pinch roller 37 and is subjected to the rotation power, whereby the document is fed to the intersection position 40 of the document feed path 32. The second front sensor 53 is turned on by feed the document G1 to the document feed path 32.

Figure 9:
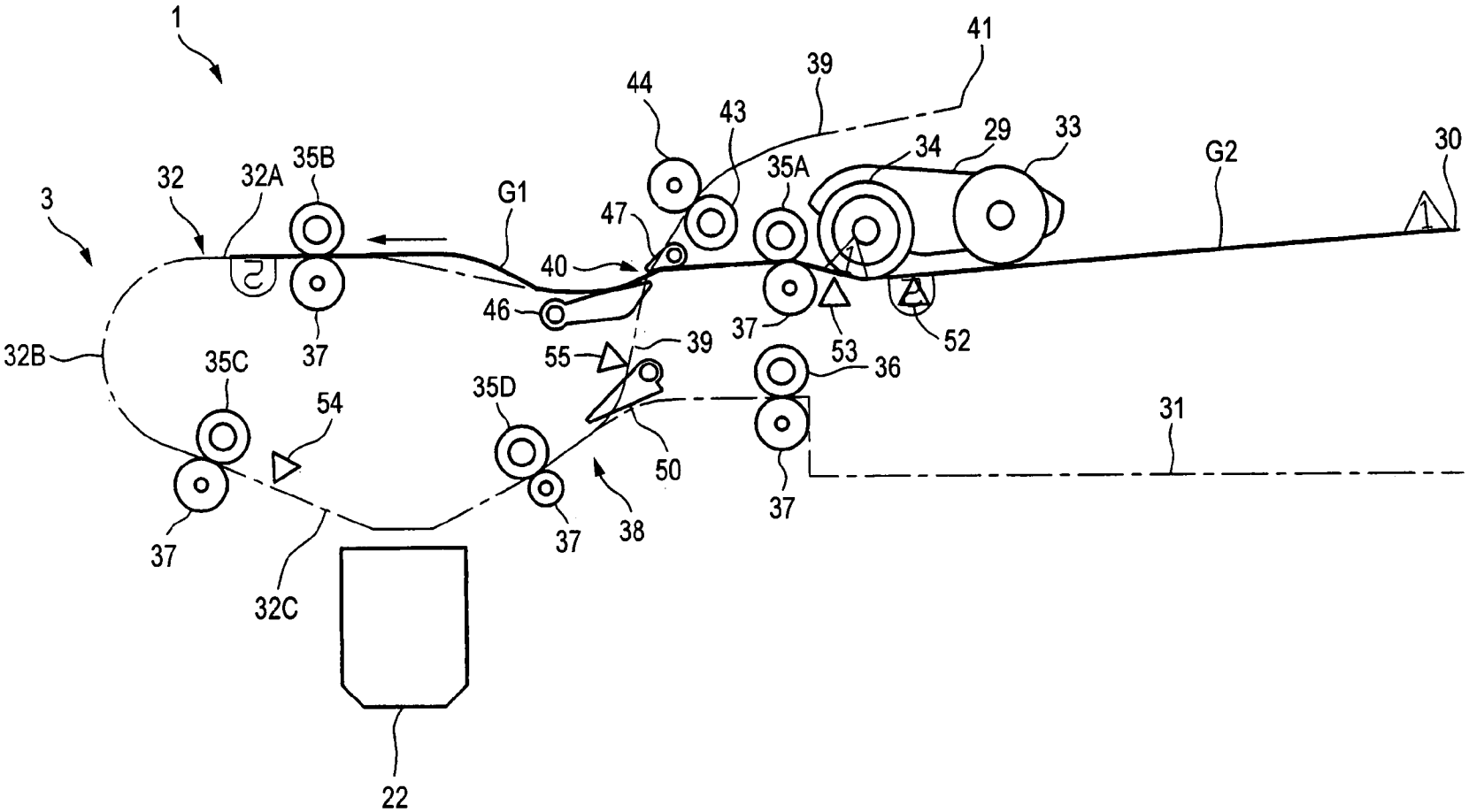
FIG. 9 is a schematic diagram illustrating a second image scanning operation in a double-sided scanning mode.

Since the guide flap 47 deactivates the feed path to the intersection position 40 from the input tray 30 in the document feed path 32, the document G1 fed to the intersection position 40 abuts on the guide flap 47. As shown in FIG. 9, the guide flap 47 is pressed to rotate by the document G1 fed in the document feed path 32 and is changed to the sixth guiding posture from the fifth guiding posture. The feed path to the connection position 38 of the bidirectional feed path 39 is deactivated by the guide flap 46.

The document GI fed from the intersection position 40 to the scanning position side in the document feed path 32 is fed in a state where the leading end in the feed direction is nipped by the feed roller 35B. As described above, since the velocities of the feed rollers 35A and 35B has the relation of Va>Vb, the document G1, which is being fed in a state where the leading end in the feed direction is nipped by the feed roller 35B and the pinch roller 37 and the trailing end in the feed direction is nipped by the feed roller 35A and the pinch roller 37, is looped between the feed rollers 35A and 35B.

Since the circumferential velocities of the feed rollers 35A, 35B, 35C, and 35D and the discharge roller 36 are greater than the circumferential velocity of the separation roller 34, the separation roller 34 is rotated by the document G1 nipped and fed by the feed roller 35A and the pinch roller 37 when the document G1 engages the separation roller 34. After the second front sensor 53 is turned off by sensing the trailing end in the feed direction of the document G1, the control unit 60 blocks the delivery of the driving power to the pick-up roller 33 and the separation roller 34.

Figure 10:
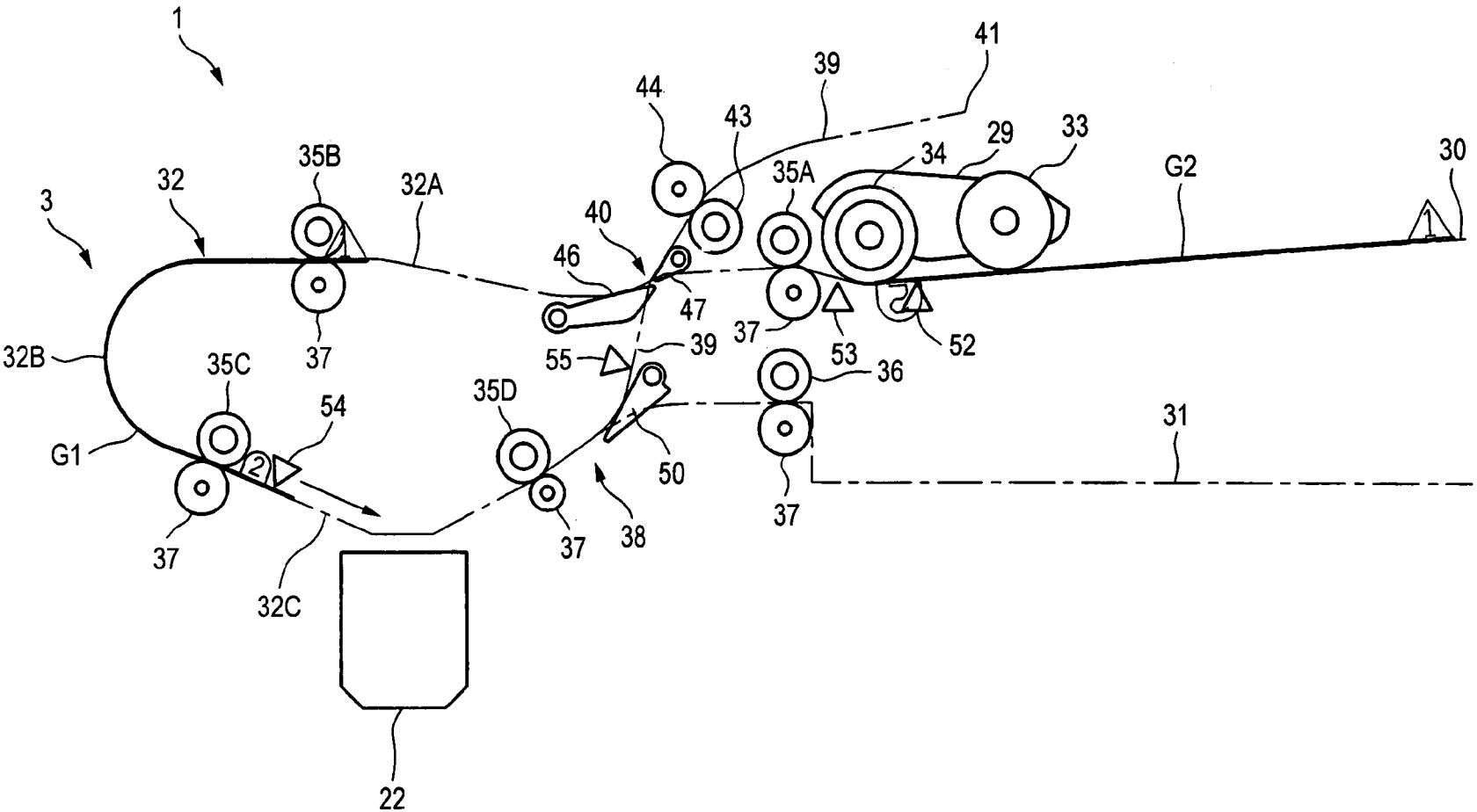
FIG. 10 is a schematic diagram illustrating a third image scanning operation in a double-sided scanning mode.

As shown in FIG. 10, the document G1 is fed to be inverted downwardly by the curved portion 32B of the document feed path 32 and the leading end thereof in the feed direction is nipped by the feed roller 35C and the pinch roller 37. As described above, among the feed rollers 35B, 35C, and 35D, the circumferential velocity of the feed roller 35C is the slowest to satisfy Vb>Vc<Vd.

The rear sensor 54 senses the leading end in the feed direction of the document G1 and is turned on. The leading end in the feed direction of the document G1 reaches the scanning position in a predetermined time after it is sensed by the rear sensor 54. When the leading end in the feed direction of the document G1 reaches the scanning position, the control unit 60 activates the image scanning unit 22 to scan the image of the document G1. The document G1 passes through the scanning position in a state where the first side is opposed to the image scanning unit 22 and the image on the first side of the document G1 is scanned by the image scanning unit 22 (S5). At the time of scanning the image of the document G1, the document G1 is fed in a state where the leading end in the feed direction is nipped between the feed roller 35D and the pinch roller 37 and the trailing edge in the feed direction is nipped between the feed roller 35C and the pinch roller 37. As described above, the circumferential velocities of the feed rollers 35C and 35D satisfy the relation of Vc<Vd.

Figure 11:
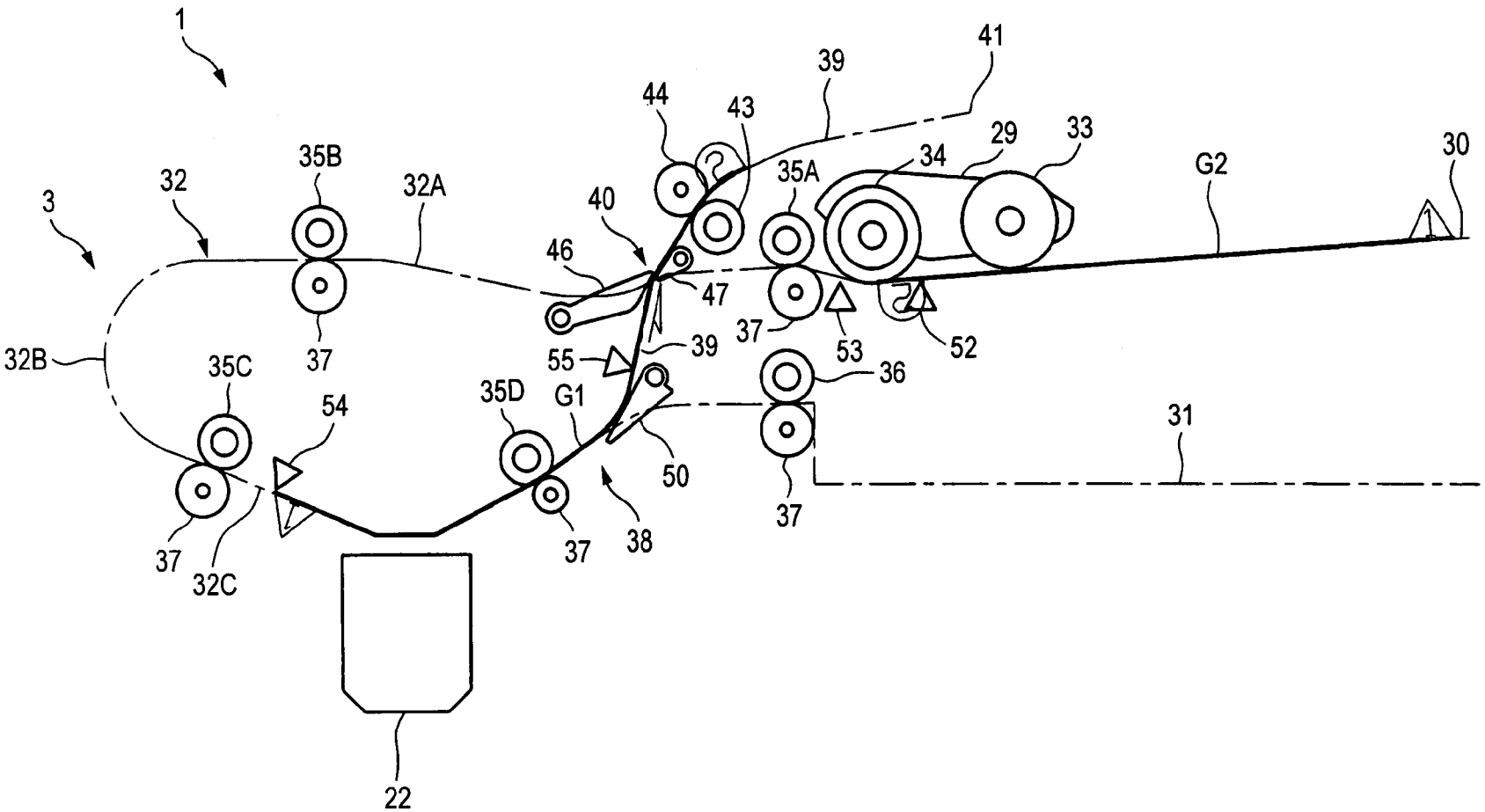
FIG. 11 is a schematic diagram illustrating a fourth image scanning operation in a double-sided scanning mode.

As shown in FIG. 11, since the leading end in the feed direction of the document G1 of which the first side has been scanned is fed in a manner (S6), the document is guided by the guide flap 50 and travels from the document feed path 32 to the bidirectional feed path 39 at the connection position 38. The guide flap 50 is changed to the second guiding posture at a time the document G1 reaches the connection position 38. The switch-back sensor 55 senses the leading end in the feed direction of the document GI entering the bidirectional feed path 39 and is turned on.

Since the guide flap 46 deactivates the feed path from the bidirectional feed path 39 to the intersection position 40, the leading end in the feed direction of the document G1 entering the bidirectional feed path 39 abuts on the guide flap 46 when it reaches the intersection position 40. As shown in FIG. 11, the guide flap 46 rotates to be pressed upwardly by the leading end in the feed direction of the document G1 fed in the bidirectional feed path 39 and is changed to the fourth guiding posture from the third guiding posture. The feed path to the input tray 30 side of the document feed path 32 is deactivated by the guide flap 47.

The leading end in the feed direction of the document G1 entering the end 41 side of the bidirectional feed path 39 through the intersection position 40 is nipped between the reversible roller 43 and the pinch roller 44 rotating in the entrance direction. As described above, the circumferential velocity of the feed roller 35D and the reversible roller 43 satisfy the relation of Vd<Vs.

As shown in FIG. 11, when the leading end in the feed direction of the document G1 is nipped between the reversible roller 43 and the pinch roller 44, the trailing end in the feed direction of the document G1 is fed opposed to the scanning position and the image is scanned by the image scanning unit 22. Since the leading end in the teed direction of the document G1 is rapidly nipped between the reversible roller 43 and the pinch roller 44, the feed of the trailing end in the feed direction of the document G1 opposed to the scanning position is not disturbed when the reversible roller 43 and the pinch roller 44 nip the document G1.

The document G1 is fed in the bidirectional feed path 39 in the state where the leading end in the feed direction is nipped between the reversible roller 43 and the pinch roller 44 and the trailing end in the feed direction is nipped between the feed roller 35D and the pinch roller 37 since the circumferential velocity Vs of the reversible roller 43 is higher than the circumferential velocity Vd of the feed roller 35D, the document G1 is fed to be drawn by the reversible roller 43 and the pinch roller 44. On the other hand, the nip pressure of the document between the reversible roller 43 and the pinch roller 44 is smaller than the nip pressure of the document G1 between the feed roller 35D and the pinch roller 37. Accordingly, when the force is increased with which the document G1 is drawn in the feed direction by the reversible roller 43 and the pinch roller 44, the document G1 is nipped by the reversible roller 43 and the pinch roller 44.

When the rear sensor 54 senses the trailing end in the feed direction of the document G1, the rear sensor is turned off. When a predetermined time has passed after the rear sensor 54 is turned off, the control unit 60 ends the image scanning of the first side of the document G1 by the image scanning unit 22. The image data of the first side scanned by the image scanning unit 22 are stored in the RAM 63 of the control unit 60.

Figure 12:
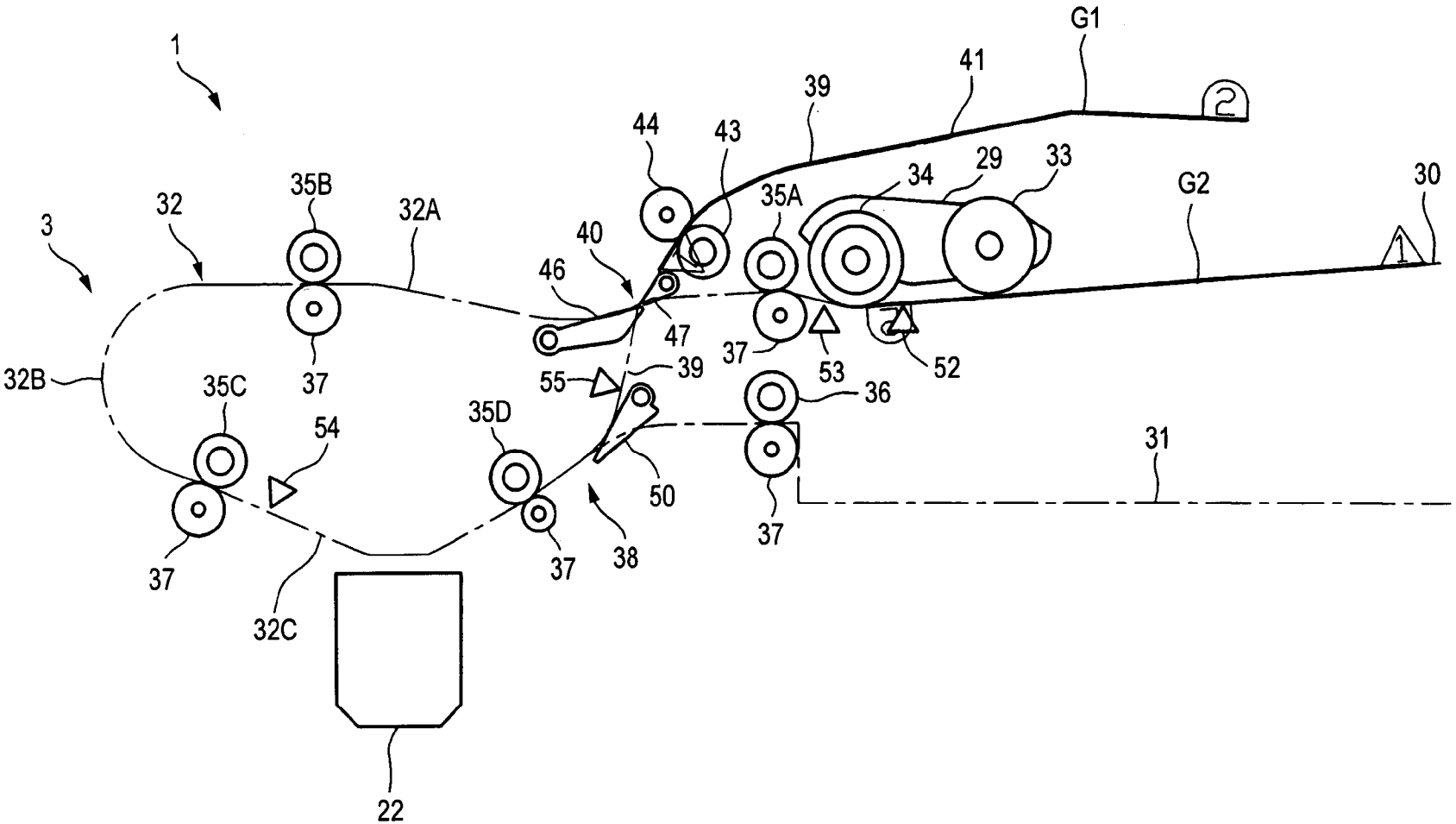
FIG. 12 is a schematic diagram illustrating a fifth image scanning operation in a double-sided scanning mode.

As shown in FIG. 12, after the trailing end in the feed direction of the document G1 completely enters the end 41 side through the intersection position 40 of the bidirectional feed path 39, the control unit 60 switches the rotation direction of the motor 67. The switch-back sensor 55 senses the trailing end in the feed direction of the document G1 fed in the bidirectional feed path 39 and is then turned off. Then, the trailing end in the feed direction of the document G1 passes through the intersection position 40 after a predetermined time has passed. The document G1, which is nipped between the reversible roller 43 and the pinch roller 44, protrudes from the end 41, and with switching of the rotation direction of the motor 67, is returned to the intersection position 40. That is, the document GI is fed in the switch-hack manner so as to be returned to the intersection position 40 through the bidirectional feed path 39 (S6).

When a part of the document G1 protrudes from the end 41 of the bidirectional feed path 39 to the outside of the ADF 3, the protruding part of the document G1 is supported by the document supporting portion 42. As the document G1 passes completely through the intersection position 40 and loses contact with the guide flap 46, the guide flap 46 rotates downwardly and is returned to the third guiding posture.

Figure 13:
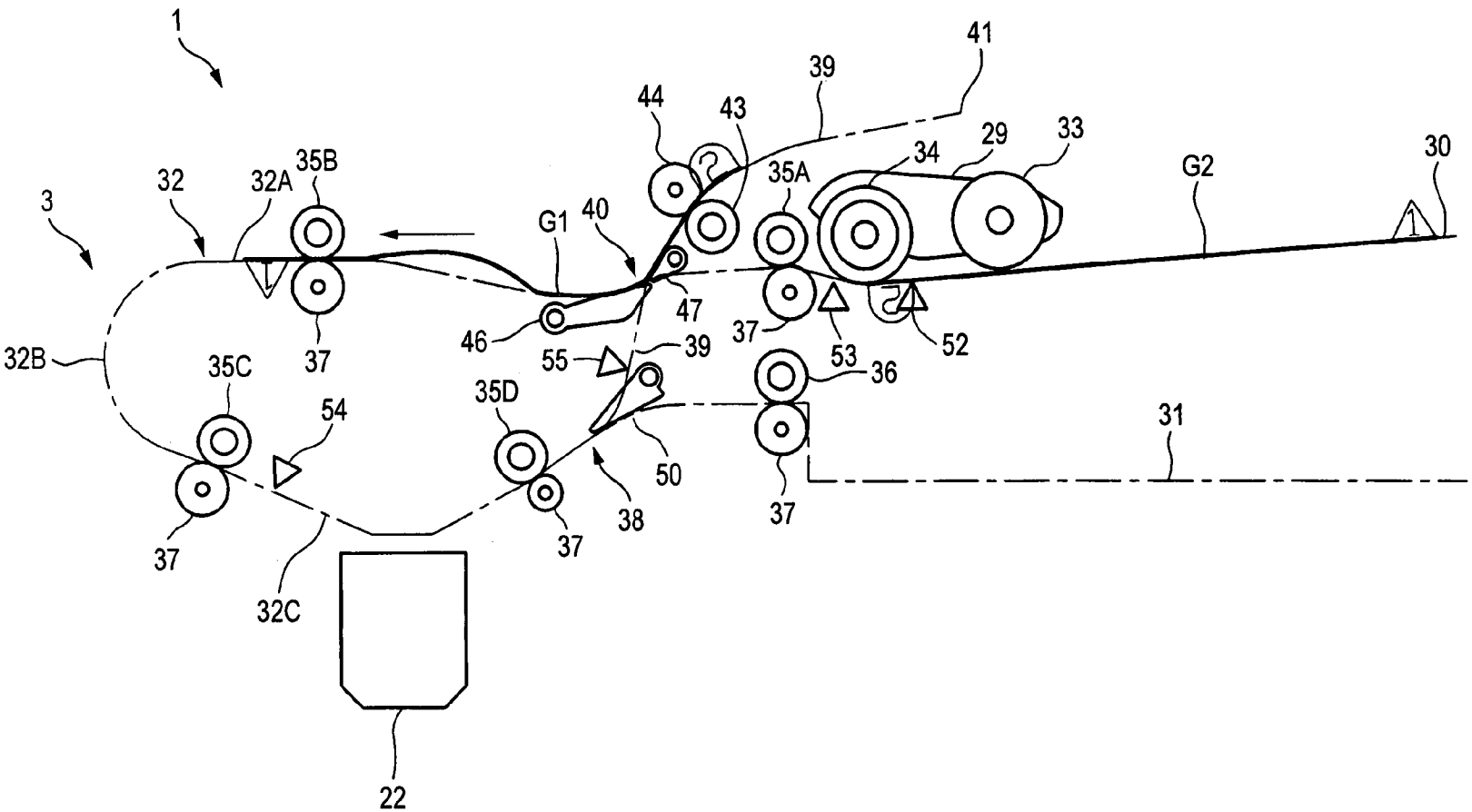
FIG. 13 is a schematic diagram illustrating a sixth image scanning operation in a double-sided scanning mode.

As shown in FIG. 13, the document G1 returned from the bidirectional feed path 39 abuts on the guide flap 46 which is in the third guiding posture at the intersection position 40. The guide flap 46 is regulated so as not to rotate downwardly from the third guiding posture. Accordingly, the feed path from the end 41 side of the bidirectional feed path 39 to the scanning position side of the document feed path 32 is activated and the feed path to the connection position 38 side of the bidirectional feed path 39 is deactivated. The guide flap 47 deactivates the feed path to the input tray 30 of the document feed path 32. Since the document G1 is returned from the bidirectional feed path 39 to the document feed path 32 on a side upstream from the scanning position, the document G1 is fed again in the document feed path 32 in the state where the leading end and the trailing end are reversed from the state in which the document was first fed in the document feed path 32. In this way, the document GI is fed in a switch-back manner.

The document G1 fed in the switch-back manner and returned to the document feed path 32 is fed in the state where the leading end in the feed direction is nipped between the feed roller 35B and the pinch roller 37 and the trailing end in the feed direction is nipped between the reversible roller 43 and the pinch roller 44. As described above, since the feed velocity of the feed roller 35B and the feed velocity of the reversible roller 43 satisfy the relation Vb<Vs, the document G1 is looped between the feed roller 35B and the reversible roller 43. The drawing force in the feed direction, which is applied to the document G1 fed in the switch-back manner, is reduced. In this way, the feed roller 35B, the pinch roller 37, the reversible roller 43, and the pinch roller 44 constitute a registration mechanism correcting the skew of the document Gn fed in the switch-back manner.

Figure 14:
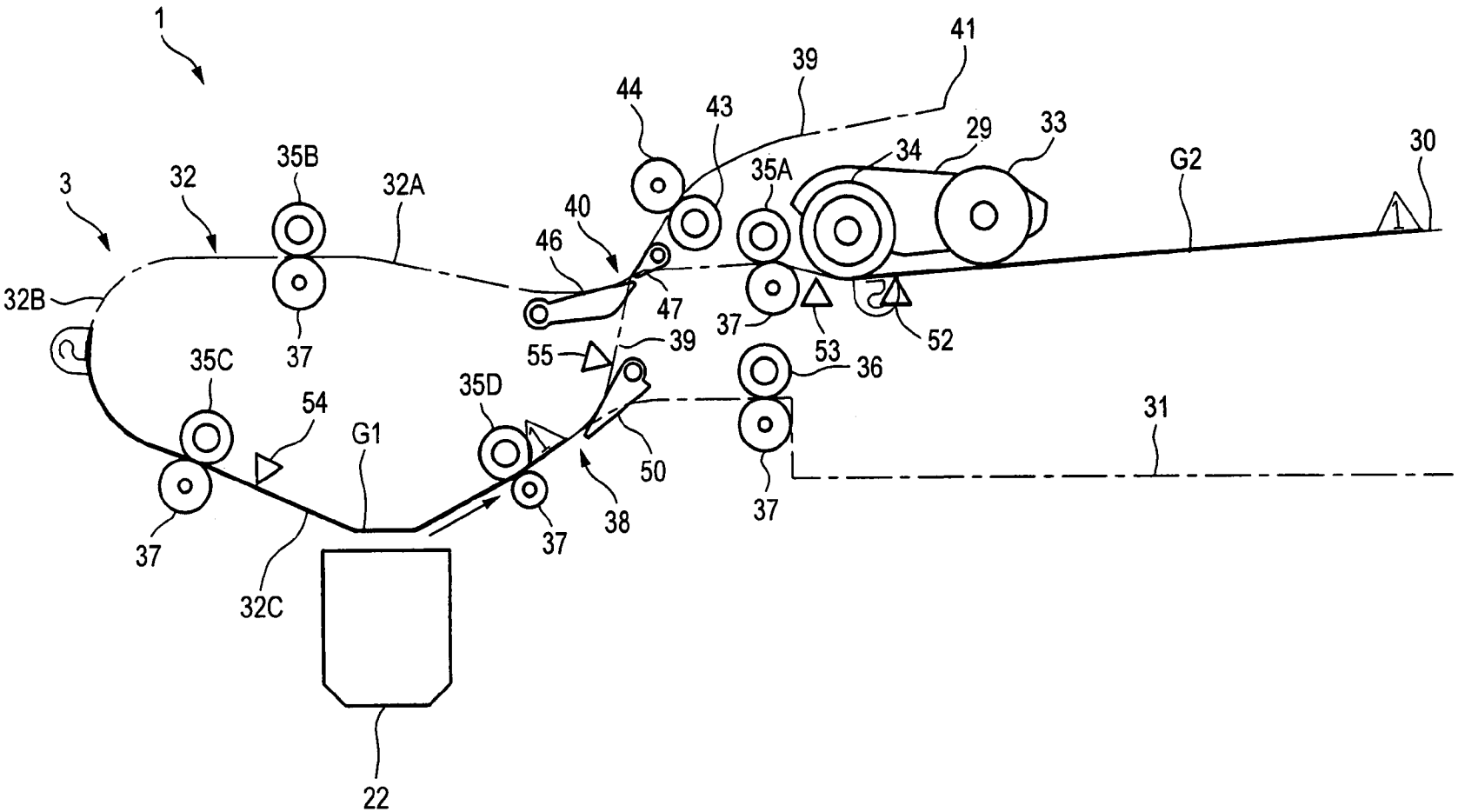
FIG. 14 is a schematic diagram illustrating a seventh image scanning operation in a double-sided scanning mode.
Figure 15:
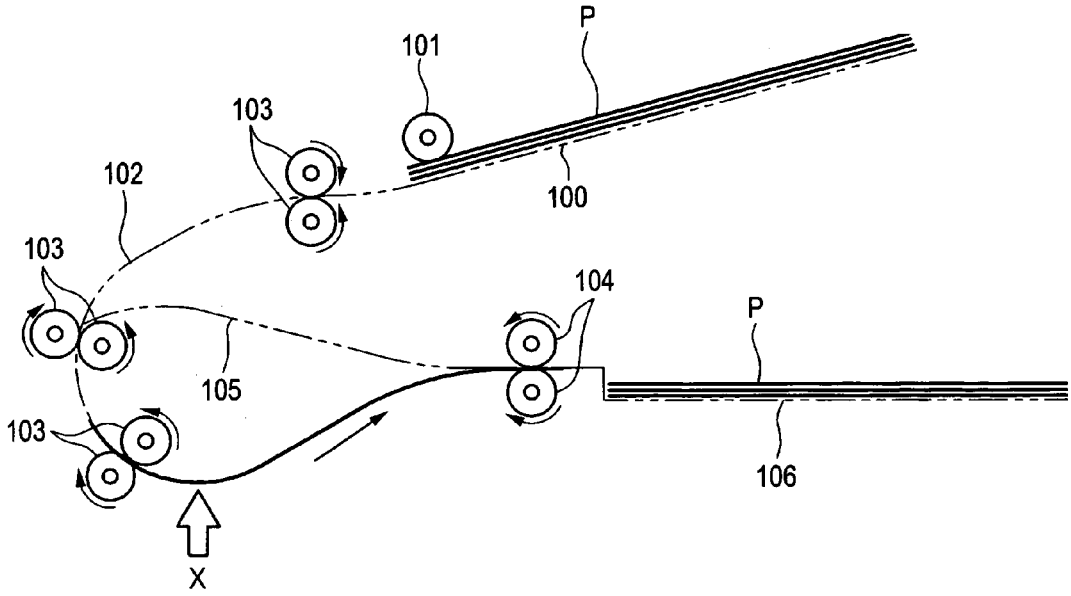
FIG. 15 is a schematic diagram illustrating a document feed operation so as to scan both sides of the document in a conventional automatic document feeder.
Figure 16:
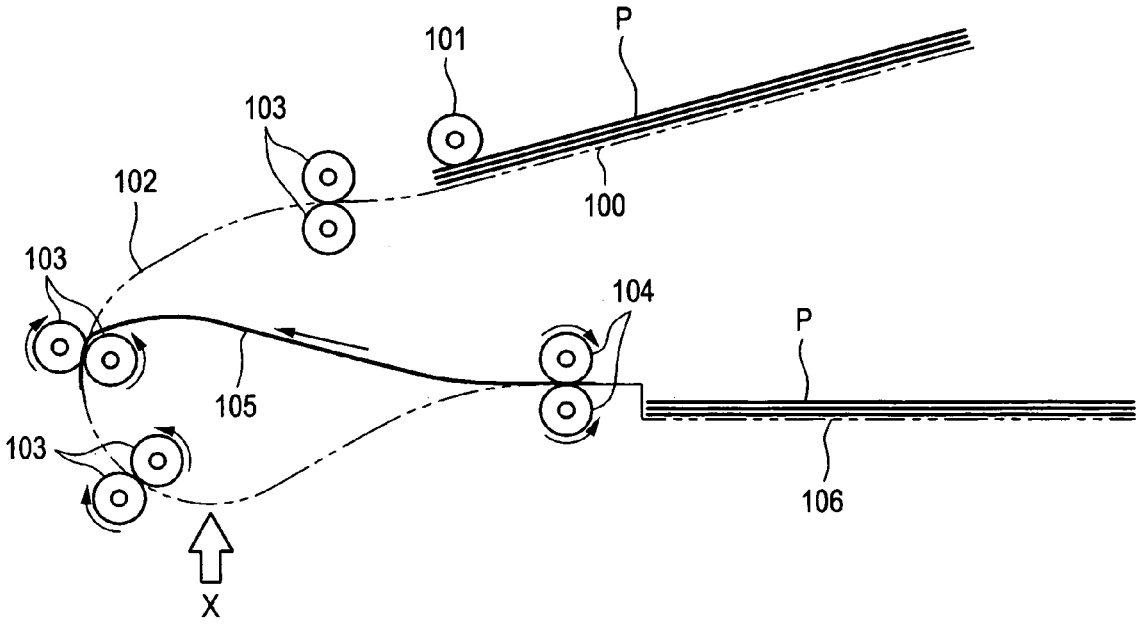
FIG. 16 is a schematic diagram illustrating a document feed operation of scanning both sides in the conventional automatic document feeder.

The document G1 of which the skew is corrected is fed downwardly along the curved portion 32B of the document feed path 32 and the leading end in the feed direction thereof is sensed by the rear sensor 54. Then, when the leading end in the feed direction of the document GI reaches the scanning position, as shown in FIG. 14, the control unit 60 allows the image scanning unit 22 to scan the image of the second side of the document G1 (S7). The document G1 passes through the scanning position with the second side opposed to the image scanning unit 22 and the image of the second side is scanned by the image scanning unit 22.

When the second side of the document G1 is scanned, the leading end in the feed direction of the document G1 entering the end 41 side of the bidirectional feed path 39 through the intersection position 40 is nipped between the reversible roller 43 and the pinch roller 44 rotating in the entrance direction. However, as described above, since the circumferential velocity of the feed roller 35D and the reversible roller 43 satisfy the relation of Vd<Vs, the leading end in the feed direction of the document G1 fed by the feed roller 35D is rapidly nipped between the reversible roller 43 and the pinch roller 44. Accordingly, the feed of the trailing end in the feed direction of the document G1 opposed to the scanning position is not disturbed at the time of scanning the second side.

The rear sensor 54 is turned off when it senses the trailing end in the feed direction of the document G1. The control unit 60 ends the scanning of the second side of the document G1 by the image scanning unit 22 in a predetermined time after the rear sensor 54 is turned off. The image data of the second side scanned by the image scanning unit 22 are stored in the RAM 63 of the control unit 60.

The document G1 of which the second side has been scanned is fed again in the switch-back manner so as to arrange the page direction (S8). That is, as shown in FIG. 11, the document G1 entering the bidirectional feed path 39 and reaching the intersection position 40 presses upwardly the guide flap 46 to pivot, changes the guide flap from the third guiding posture to the fourth guiding posture, and enters the end 41 side of the bidirectional feed path 39 through the intersection position 40. Then, as shown in FIG. 12, after the trailing end in the feed direction of the document G1 passes through the intersection position 40 of the bidirectional feed path 39 and enters the end 41 side completely, the control unit 60 changes the rotation direction of the motor 67 to allow the reversible roller 43 to rotate in the reverse direction, thereby returning the document G1 to the intersection position 40. Thereafter, as shown in FIG. 13, the document G1 returned from the bidirectional feed path 39 is guided by the guide flap 46 and the guide flap 47 and is fed from the end 41 side of the bidirectional feed path 39 to the scanning position side of the document teed path 32. Accordingly, the document G1 is fed again along the document feed path 32 in the state where the leading and the trailing end are reversed again, that is, in the state where the document is initially fed to the document feed path 32.

Thereafter, the document G1 passes through the scanning position with the first side opposed thereto. At this time, the rear sensor 54 senses the document G1 and is turned on. However, since this feed is to unload the documents Gn placed on the input tray 30 to the output tray 31 with the order of the documents unchanged, the control unit 60 does not scan the document G1.

The document G1 reaching the connection position 38 is guided to the output tray 31 through the connection position 38 by the guide flap 50 and is fed to the output tray 31 by the discharge roller 36 with the first side directed downward. The guide flap 50 is changed to the first guiding posture at any time prior to the document G1 reaching the connection position 38. The document G1 is nipped between the discharge roller 36 and the pinch roller 37 and is discharged to the output tray 31 with the first side directed downward (S9).

The control unit 60 determines whether a document G2 to be scanned next is set on the input tray 30 when the double-sided scanning of the document G1 is ended (S10). When the next document G2 is set on the input tray 30, the front sensor 52 is turned on. When the control unit 60 determines that the document G2 is set (S10: Y), the controller delivers the driving power from the motor 67 to the pick-up roller 33 and the separation roller 34 to allow the rollers to rotate. Accordingly, the document G2 on the input tray 30 is fed to the document feed path 32 and is subjected to the double-sided scanning, similar to document G1. On the other hand, when no document Gn remains (S10: N), the control unit 60 ends the double-sided scanning operation.

In the image reading apparatus 1, since the 6 circumferential velocity Vs of the reversible roller 43 and the pinch roller 44, which nip the leading end in the feed direction of the document Gn fed opposed to the scanning position, is set higher than the circumferential velocity Vd of the feed roller 35D and the pinch roller 37 which nip the trailing end in the feed direction, the leading end in the feed direction of the document Gn is rapidly nipped between the reversible roller 43 and the pinch roller 44 and thus the feed of the document Gn opposed to the scanning position is not disturbed.

Since the circumferential velocity Vb of the feed roller 35B and the pinch roller 37 nipping the leading end in the feed direction of the document Gn fed in the switch-back manner is set lower than the circumferential velocity Vs of the reversible roller 43 and the pinch roller 44 nipping the trailing end in the feed direction, the drawing force in the feed direction, which acts on the document Gn fed in the switch-back manner is reduced. The register mechanism correcting the skew of the document Gn is embodied by the feed roller 35B, the pinch roller 37, the reversible roller 43, and the pinch roller 44.

The difference in circumferential velocity between the feed rollers 35B, 35C, and 35D and the reversible roller 43 for maintaining the feed precision of the image reading apparatus 1 or embodying the resist mechanism can be properly set on the basis of the distance between the rollers and the like. For example, by setting the difference in circumferential velocity to about 5%, the advantage of the aspect of the invention can be exhibited.

In this aspect, the double-sided scanning operation of the image reading apparatus 1 has been described on the premise that the documents are unloaded to the output tray 31 in the state where the order of documents Gn placed on the input tray 30 is not changed. However, when it is not necessary to match the order of documents Gn placed on the input tray 30 with the order of documents Gn unloaded to the output tray 31, the document Gn may be fed to the output tray 31 side through the connection position 38 and then the document Gn may be unloaded to the output tray 31, without allowing the document Gn to enter the bidirectional feed path 39 again after feed the document Gn with the second side of the document opposed to the scanning position. Accordingly, since the order of the documents Gn on the output tray 31 is not maintained but the final bidirectional feed operation can be omitted, it is possible to reduce the time necessary for performing the double-sided scanning operation to the documents Gn. By simultaneously performing the unloading of the document G1 and the loading of the document G2, the feed time for continuously scanning both sides of a plurality of documents Gn may be reduced.

When the single-sided scanning mode is set, the control unit 60 allows the motor 67 to rotate and a document Gn enters the document feed path 32 from the input tray 30. When the document Gn reaches the scanning position, the first side is scanned. When the document Gn passes through the scanning position, the document Gn is discharge onto the output tray 31 by the discharge roller 36. In the single-sided scanning mode, by setting the circumferential velocity Ve of the discharge roller 36 greater than the circumferential velocity of the feed roller 35D, the leading end in the feed direction of the document Gn fed opposed to the scanning position is rapidly nipped by the discharge roller 36 and the pinch roller 37. Accordingly, in the single-sided scanning mode, it is possible to feed a document to the scanning position with feed precision suitable for scanning an image. By setting the nip pressure between the discharge roller 36 and the pinch roller 37 smaller than the nip pressure of the feed roller 35D and the pinch roller 37, the force can be reduced in a direction in which the document Gn is drawn. That is, the discharge roller 36 and the pinch roller 37 can be embodied as the second feed roller pair.

Further, although the difference in circumferential velocity is utilized in the above-described aspect, the difference in coefficient of friction may be alternatively utilized.

What is claimed is:

1. A feeder for documents or other sheet materials, comprising:

an inlet;

an outlet;

a transfer path that guides a document during transfer from the inlet via a scanning point to the outlet;

a transfer system that moves a document or other material along the transfer path;

a first transfer element included in the transfer system at a position downstream of the scanning point;

a second transfer element included in the transfer system at a position downstream of the first transfer element, the second transfer element configured to be rotatable in a normal direction and a reverse direction;

a third transfer element included in the transfer system at a position upstream of the scanning point; and a controller configured to set a transfer force of the second transfer element that rotates in the normal direction to be greater than that of the first transfer element, the controller configured to set a transfer force of the second transfer element that rotates in the reverse direction to be greater than that of the third transfer element, wherein the second transfer element is disposed in a position in the feeder higher than a position in which the third transfer element is disposed in a direction perpendicular to a line intersecting the scanning point when the feeder is configured to be utilized with an image scanner, and the position in which the third transfer element is disposed in the feeder is higher than a position in which the first transfer element is disposed, and wherein the third transfer element and the second transfer element are configured in the transfer system to nip the document simultaneously when the second transfer element rotates in the reverse direction.

2. A feeder according to claim 1, wherein the transfer force includes a circumferential velocity of the transfer element, and the controller is configured to set the circumferential velocity of the second transfer element to be greater than that of the first transfer element.

3. A feeder according to claim 1, wherein the first transfer element includes a pair of first transfer rollers and the second transfer element includes a pair of second transfer rollers, and p1 a nip pressure of the pair of second transfer rollers is set smaller than that of the pair of first transfer rollers.

4. A feeder according to claim 1, wherein the transfer path includes:

an input transfer path that guides a document during transfer from the inlet via the scanning point to an end point;

an intermediate transfer path that guides the document during transfer from the end point via the scanning point to the end point again; and an output transfer path that guides the document during transfer from the end point via the scanning point to the outlet.

5. A feeder according to claim 4, wherein the second transfer element is provided at the end point.

6. A feeder according to claim 5, wherein the second transfer element includes a reversible transfer roller.

7. A feeder according to claim 4, wherein the end point is positioned above the inlet and the outlet.

8. A feeder according to claim 7, further including a transfer motor that drives a reversible transfer roller in two separate directions, one opposite the other at separate times.

9. A feeder according to claim 8, wherein in the input transfer path, the reversible transfer roller is driven in one direction and in the output transfer path the reversible transfer roller is driven in the opposite direction.

10. A feeder according to claim 9, further comprising a sensor in the input transfer path for determining when the document passes the reversible transfer roller, and in response to the sensor determining the document passing the reversible transfer roller, the transfer motor drives the reversible transfer roller in the opposite direction.

11. A feeder according to claim 4, further comprising a discharge transfer element included in the transfer system at the outlet, and the controller is configured to set a circumferential velocity of the discharge transfer element to be greater than that of the first transfer element.

12. A feeder according to claim 1, further comprising a discharge transfer element included in the transfer system at the outlet, and the controller is configured to set a circumferential velocity of the discharge transfer element to be greater than that of the first transfer element.

13. A feeder according to claim 12, further comprising a fourth transfer element included in the transfer system at a position downstream of the third transfer element, the controller is configured to set a circumferential velocity of the third transfer element to be greater than that of the fourth transfer element.

14. A feeder according to claim 1, further comprising a third transfer element included in the transfer system at a position upstream of the scanning point, and the controller is configured to set a circumferential velocity of the second transfer element to be greater than that of the third transfer element.

* * * * *